US009845961B2

(12) United States Patent
Saito et al.

(10) Patent No.: US 9,845,961 B2
(45) Date of Patent: Dec. 19, 2017

(54) HUMIDIFIER AND METHOD OF HYDROPHILIZATION PROCESSING FOR HUMIDIFYING MATERIAL

(71) Applicant: Mitsubishi Electric Corporation, Chiyoda-ku (JP)

(72) Inventors: Tadashi Saito, Chiyoda-ku (JP); Seiji Noda, Chiyoda-ku (JP); Kazuhiro Miya, Chiyoda-ku (JP); Seiji Furukawa, Chiyoda-ku (JP); Takafumi Nakai, Chiyoda-ku (JP)

(73) Assignee: Mitsubishi Electric Corporation, Chiyoda-ku (JP)

( * ) Notice: Subject to any disclaimer, the term of this patent is extended or adjusted under 35 U.S.C. 154(b) by 183 days.

(21) Appl. No.: 14/418,247

(22) PCT Filed: Jun. 28, 2013

(86) PCT No.: PCT/JP2013/067918
§ 371 (c)(1),
(2) Date: Jan. 29, 2015

(87) PCT Pub. No.: WO2014/045668
PCT Pub. Date: Mar. 27, 2014

(65) Prior Publication Data

US 2015/0153052 A1 Jun. 4, 2015

(30) Foreign Application Priority Data

Sep. 20, 2012 (JP) ..... 2012-206452

(51) Int. Cl.

| | |
|---|---|
| ***F24F 6/04*** | (2006.01) |
| ***B01F 3/04*** | (2006.01) |
| *F24F 11/00* | (2006.01) |

(52) U.S. Cl.
CPC ..... *F24F 6/04* (2013.01); *B01F 3/04007* (2013.01); *F24F 11/0008* (2013.01);
(Continued)

(58) Field of Classification Search
CPC ..... F24F 11/0008; F24F 5/0035; F24F 2006/046; F24F 6/04; F24F 11/001;
(Continued)

(56) References Cited

U.S. PATENT DOCUMENTS 2,099,009 A * 11/1937 Finley ..... F24D 19/0082 160/44
2,161,834 A * 6/1939 Seeley ..... F24D 19/0082 237/78 R (Continued)

FOREIGN PATENT DOCUMENTS

JP 59 112897 6/1984
JP 2004 85136 3/2004

(Continued)

OTHER PUBLICATIONS

Sommers et al. "Creating micro-scale surface topology to achieve anisotropic wettability on an alumnium surface" Journal of Micromechanics and Microengineering 16 (2006) 1571-1578.*

(Continued)

*Primary Examiner* — Amber R Orlando
*Assistant Examiner* — Stephen Hobson
(74) *Attorney, Agent, or Firm* — Oblon, McClelland, Maier & Neustadt, L.L.P.

(57) ABSTRACT

A humidifier obtains, based on detection values of a first and second temperature and humidity sensors, the amount of humidification, the amount of water evaporated by a humidifying material per preset time, controls the amount of water supplied by a water supply unit per the preset time to be smaller than a specific value when the amount of humidi- (Continued)

fication obtained at the present time is increased compared to the amount of humidification obtained at the previous time, and controls the amount of water supplied by the water supply unit per the preset time to be equal to or greater than the specific value when the amount of humidification obtained at the present time is decreased compared to the amount of humidification obtained at the previous time or when the amount of humidification obtained at the present time is equal to the amount of humidification obtained at the previous time.

11 Claims, 14 Drawing Sheets

(52) U.S. Cl.
CPC ..... *B01F 2215/0091* (2013.01); *F24F 11/001* (2013.01); *F24F 11/0012* (2013.01); *F24F 11/0015* (2013.01); *F24F 2006/046* (2013.01)

(58) Field of Classification Search
CPC ..... F24F 11/0012; F24F 11/0015; B01F 3/04007; B01F 2215/0091
See application file for complete search history.

(56) References Cited

U.S. PATENT DOCUMENTS 2,326,089 A * 8/1943 Wittman ..... F24D 19/0082 126/113
3,378,238 A * 4/1968 Babington ..... F24F 6/04 126/113
4,389,352 A * 6/1983 Bohanon, Sr. ..... F24F 6/04 261/106
4,429,735 A * 2/1984 Nomaguchi ..... B05B 3/001 165/60
5,425,902 A * 6/1995 Miller ..... B01J 19/32 261/128
5,738,808 A * 4/1998 Iwamoto ..... A61M 16/16 128/204.13
5,966,953 A * 10/1999 Murr ..... A01K 1/0082 261/27
6,209,570 B1 * 4/2001 DeBello ..... F24F 5/0035 119/437
6,394,427 B1 * 5/2002 Guetersloh ..... F24F 6/02 261/106
9,221,694 B1 * 12/2015 Govindan ..... C02F 1/042
2005/0079124 A1 * 4/2005 Sanderson ..... A61L 9/145 423/477
2006/0157422 A1 * 7/2006 Freydina ..... B01D 61/46 210/746
2010/0281896 A1 * 11/2010 Al Watban ..... F24F 5/0035 62/160
2011/0203978 A1 * 8/2011 Handy ..... C02F 5/025 210/120
2012/0283668 A1 * 11/2012 Shalev ..... A45D 34/04 604/290
2013/0106004 A1 * 5/2013 Stumphauzer ..... F24F 6/04 261/128
2013/0186611 A1 * 7/2013 Schneider ..... F24F 11/0008 165/226
2013/0213076 A1 * 8/2013 Gerlach ..... F24F 13/15 62/314
2016/0146483 A1 * 5/2016 Sakai ..... F24F 6/04 62/176.4

FOREIGN PATENT DOCUMENTS

JP 2005 24176 1/2005
JP 2007 198685 8/2007
JP 2009 47402 3/2009
JP 2012 93045 5/2012
JP 2014137201 A * 7/2014
JP WO 2014115564 A1 * 7/2014 ..... F24F 6/043
JP 2014202438 A * 10/2014

OTHER PUBLICATIONS

Office Action dated Jan. 5, 2016 in Japanese Patent Application No. 2014-536632 with English translation.
International Search Report dated Sep. 17, 2013 in PCT/JP13/067918 filed Jun. 28, 2013.
Combined Office Action and Search Report dated Nov. 9, 2016 in Chinese Patent Application No. 201380048946.9 (with partial English translation and English translation of categories of cited documents).

* cited by examiner

HUMIDIFIER AND METHOD OF HYDROPHILIZATION PROCESSING FOR HUMIDIFYING MATERIAL

TECHNICAL FIELD

The present invention relates to a humidifier including a humidifying material and a method of hydrophilic treatment for the humidifying material.

BACKGROUND ART

Humidifying methods for humidifiers which humidify air include an evaporation method. Evaporative humidifiers perform humidification of air by causing the air to pass through a humidifying material having a water absorption function and thus allowing heat exchange between moisture contained in the humidifying material and an air flow to vaporize and evaporate, achieving humidification.

Conventionally, there have been demands for an enhancement of the humidifying performance of evaporative humidifiers and a long-term maintenance of the humidifying performance.

In order to satisfy the above issues, various methods and apparatuses have been considered.

For example, in a technique described in Patent Literature 1, concavities and convexities are formed on a surface of a porous metallic plate having a three-dimensional net-like structure, and a high-porosity part and a low-porosity part are formed in two directions in a dispersed manner. It is considered that, with this technique, a large amount of water for evaporation is supplied to an evaporation interface in a stable manner and uniform and rapid evaporation is able to occur from the whole surface.

Furthermore, in a technique described in Patent Literature 2, particles are held on a surface of a filter substrate material of an evaporating filter to form voids. It is considered that, with this technique, concavities, convexities, and voids formed by particles on the filter surface allow water to be held and released, humidification is carried out in a surface part of the evaporating filter, and a high humidifying performance can be achieved.

CITATION LIST

Patent Literature

Patent Literature 1: Japanese Unexamined Patent Application Publication No. 2012-93045

Patent Literature 2: Japanese Unexamined Patent Application Publication No. 2007-198685

SUMMARY OF INVENTION

Technical Problem

With the use of the humidifying materials having the configuration in the techniques described in Patent Literature 1 or Patent Literature 2, a humidifying performance based on the specifications can be obtained at the beginning of the operation of the humidifier.

However, with repetition of humidification, hydrophilic treatment performed on the humidifying material is deteriorated by organic substances and the like contained in supplied water, and scales caused by a silica component and a mineral component contained in the supplied water are deposited and accumulated. Accordingly, holes formed in the humidifying material are clogged.

Consequently, a problem occurs in which water cannot be stably supplied to an evaporation surface of the humidifying material and the humidifying performance degrades.

The present invention has been made in order to solve the above problem, and obtains a humidifier capable of enhancing the humidifying performance and a method of hydrophilic treatment for a humidifying material. Furthermore, the present invention obtains a humidifier capable of suppressing a degradation of the humidifying performance and a method of hydrophilic treatment for a humidifying material.

Solution to Problem

A humidifier according to the present invention includes a humidifying material that evaporates water to humidify air; a water supply unit that supplies water to the humidifying material; a fan that blows air toward the humidifying material; a first temperature and humidity sensor that detects a temperature and a humidity of the air before passing through the humidifying material; a second temperature and humidity sensor that detects a temperature and a humidity of the air after passing through the humidifying material; and a controller that controls an amount of water supplied by the water supply unit. The controller obtains, based on detection values of the first temperature and humidity sensor and the second temperature and humidity sensor, an amount of humidification, which is an amount of water evaporated by the humidifying material per preset time, controls, in a case where the amount of humidification obtained at a present time is increased compared to the amount of humidification obtained at a previous time, the amount of water supplied by the water supply unit per the preset time to be smaller than a specific value, and controls, in a case where the amount of humidification obtained at the present time is decreased compared to the amount of humidification obtained at the previous time or in a case where the amount of humidification obtained at the present time is equal to the amount of humidification obtained at the previous time, the amount of water supplied by the water supply unit per the preset time to be equal to or greater than the specific value.

A humidifier according to the present invention includes a humidifying material that evaporates water which is impregnated therein to humidify air; a water supply unit that supplies water to the humidifying material; a fan that blows air toward the humidifying material; and a controller that controls an amount of water supplied by the water supply unit. The controller, after causing the water supply unit to supply water at a predetermined specific value or below and enhancing a humidifying performance by causing scales to be accumulated on the humidifying material, causes the water supply unit to supply water at a flow rate that exceeds the specific value to perform humidification while maintaining the humidifying performance of the humidifying material.

Advantageous Effects of Invention

In the present invention, by controlling the amount of water supplied by the water supply unit to be smaller than the amount of humidification, it is possible to perform hydrophilic treatment using a scale component and enhance the humidifying performance. Furthermore, by controlling the amount of water supplied by the water supply unit to be equal to or greater than the amount of humidification, it is possible to suppress a degradation of the humidifying performance.

DESCRIPTION OF EMBODIMENTS

Embodiment 1

Figure 1:
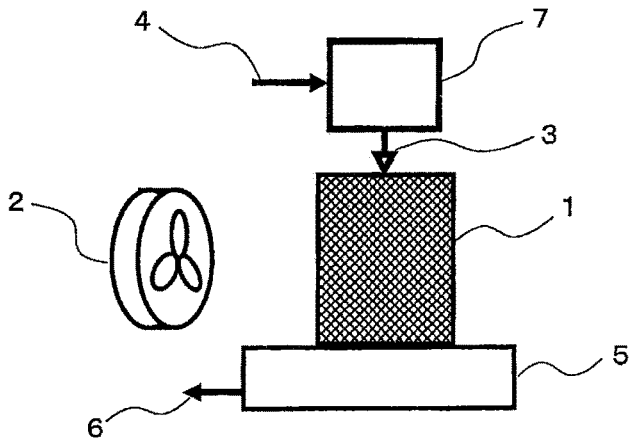
FIG. 1 is a diagram illustrating a basic configuration of a humidifier according to Embodiment 1.
Figure 10:
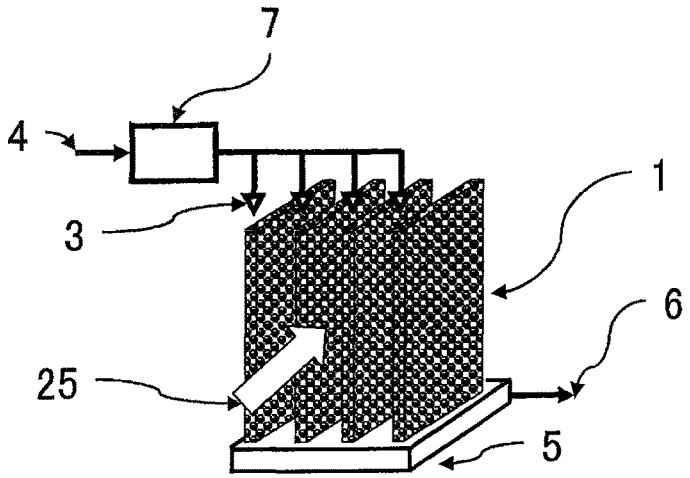
FIG. 10 is a diagram illustrating a basic configuration of the humidifier according to Embodiment 1.

FIG. 1 and FIG. 10 are diagrams illustrating a basic configuration of a humidifier according to Embodiment 1.

In FIG. 1, the humidifier includes a humidifying material 1, a fan 2, a water supply unit 3, a water feeding unit 4, a drain pan 5, a drain outlet 6, and a humidifying performance control unit 7. The humidifying material 1 evaporates water to humidify the air. The fan 2 blows air toward the humidifying material 1. The water supply unit 3 supplies water to the humidifying material 1. The water feeding unit 4 feeds water to the water supply unit 3. The drain pan 5 receives water which has flowed out of the humidifying material 1. Water received by the drain pan 5 is drained through the drain outlet 6. The humidifying performance control unit 7 is provided between the water supply unit 3 and the water feeding unit 4.

As illustrated in FIG. 10, the humidifying material 1 may be set in a plural form. The plurality of humidifying materials 1 are arranged with spaces therebetween. The water supply unit 3 supplies water to each of the plurality of humidifying materials 1. An air-blowing direction 25 is a direction in which air from the fan 2 passes through in between the plurality of humidifying materials 1.

The humidifying performance control unit 7 of Embodiment 1 will be specifically described below.

Figure 2:
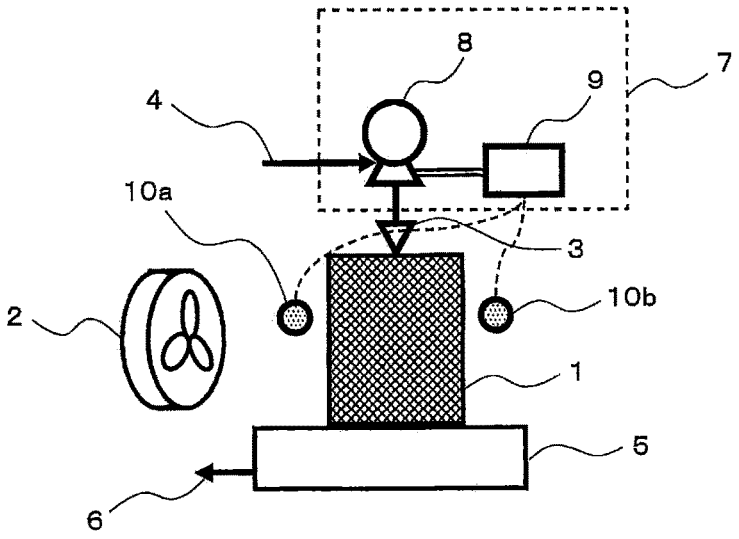
FIG. 2 is a diagram illustrating a configuration of humidifiers according to Embodiments 1, 8, 9, 12, and 13.

FIG. 2 is a diagram illustrating a configuration of the humidifier according to Embodiment 1.

In FIG. 2, the humidifying performance control unit 7 of Embodiment 1 includes a pump 8 and a controller 9. The pump 8 delivers water from the water feeding unit 4 to the water supply unit 3. The controller 9 adjusts the flow rate of the pump 8 to control the amount of water supplied by the water supply unit 3 to the humidifying material 1.

The humidifying material 1 includes a first temperature and humidity sensor 10*a* and a second temperature and humidity sensor 10*b*. The first temperature and humidity sensor 10*a* detects the temperature and humidity of air before passing through the humidifying material 1. The second temperature and humidity sensor 10*b* detects the temperature and humidity of air after passing through the humidifying material 1.

The controller 9 obtains detection values of the first temperature and humidity sensor 10*a* and the second temperature and humidity sensor 10*b*.

The humidifying material 1 is a member capable of retaining water and allowing evaporation and humidification by causing air to pass through the humidifying material 1. The humidifying material 1 preferably has a plate shape and is made of resin or metal. The humidifying material 1 further preferably has an entangled fiber form with a cubic net-like structure or a foam form. The resin member may be, for example, polyurethane, polyethylene, polyvinyl alcohol, polypropylene, or polyethylene terephthalate. The metal member may be, for example, titanium, stainless steel, copper, aluminum, or iron. In Embodiment 1, as the humidifying material 1, a foam metal made of titanium with a porosity of 90% and a nominal hole diameter of 600 micrometers is used.

The water supply unit 3 is such a shape that is capable of supplying water uniformly to the entire surface of the humidifying material 1. It is desirable that water is supplied from at least one or more water supply units 3 to a single humidifying material 1. Preferably, the water supply unit 3 is such a shape that the entire upper surface of the humidifying material 1 is soaked with supplied water. In Embodiment 1, for a single humidifying material 1, a stainless-steel nozzle is positioned at approximately 3 mm directly above around the center of the upper end surface of the humidifying material 1.

Humidification operations of the humidifier according to Embodiment 1 of the present invention will be described below.

Water supplied from the water feeding unit 4 is supplied by the pump 8 from the water supply unit 3 to the humidifying material 1. At this time, the controller 9 adjusts the flow rate of the pump 8 to control the amount of water supplied from the water supply unit 3 to the humidifying material 1. The water supplied to the humidifying material 1 permeates the humidifying material 1 by a capillary phenomenon. Then, by blowing air from the fan 2 to the humidifying material 1, water evaporates from the surface of the humidifying material 1. With the water evaporation, the air passing through the humidifying material 1 is humidified. The amount of water supplied to air by the humidification (the amount of water evaporated by the humidifying material 1) is called the amount of humidification. Further, the minimum value of the amount of water supplied to the humidifying material 1 which provides the humidifying material 1 with the maximum amount of humidification is called a minimum value Smin. Even when an amount of water exceeding the minimum value Smin is supplied to the humidifying material 1, the amount of humidification does not increase and the maximum amount of humidification remains unchanged. Water exceeding the minimum value Smin supplied to the humidifying material 1 flows down to the drain pan 5 and is drained through the drain outlet 6.

Features of the humidifier according to Embodiment 1 of the present invention will be described below.

Water supplied to the humidifying material 1 contains a silica component (for example, calcium silicate, magnesium silicate, aluminum silicate, silica colloid, and the like) and a mineral component (for example, calcium carbonate, magnesium carbonate, calcium sulfate, magnesium hydroxide, calcium phosphate, and the like). When water containing the silica component and the mineral component evaporates on the surface of the humidifying material 1 and air is humidified, the concentration of the components increases. Then, when the concentration exceeds a saturated dissolved concentration, the component is deposited as a solid component on the humidifying material 1. Accumulation of scales on the humidifying material 1 generated from at least either of the silica component or the mineral component will cause a degradation of the humidifying performance, such as clogging of the humidifying material 1.

Figure 9:
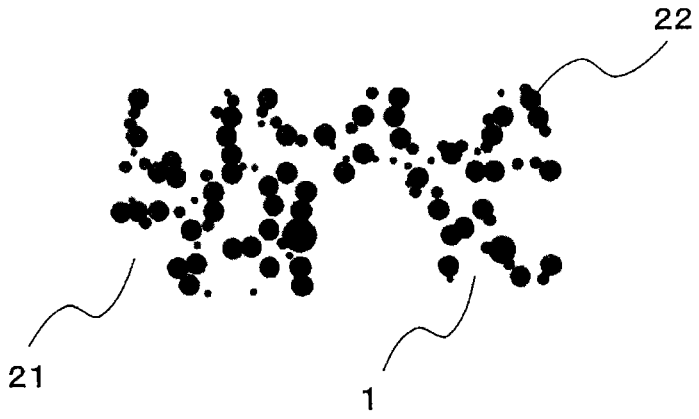
FIG. 9 is a diagram schematically illustrating a state in which scales are attached to a humidifying material.

However, as illustrated in FIG. 9, the inventors confirmed by an experiment that portions of the humidifying material 1 having voids 21 formed thereon to which scales 22 are attached, have concavities and convexities of the order of nanometers to micrometers, and the surface area is accordingly increased. Further, the inventors confirmed that, as illustrated in FIG. 9, the contact angle of the portions of the humidifying material 1 having the voids 21 formed thereon to which the scales 22 are attached, decreases from 116.5 degrees to 15.5 degrees, thus drastically improving hydrophilization. Then, the inventors came up with an idea to utilize the characteristic reversely. As a result of repeated experiments in an attempt to embody the idea, the inventors found a control method capable of enhancing the humidifying performance and maintaining a high humidifying performance.

The control method will be described below with reference to FIG. 3.

Figure 3:
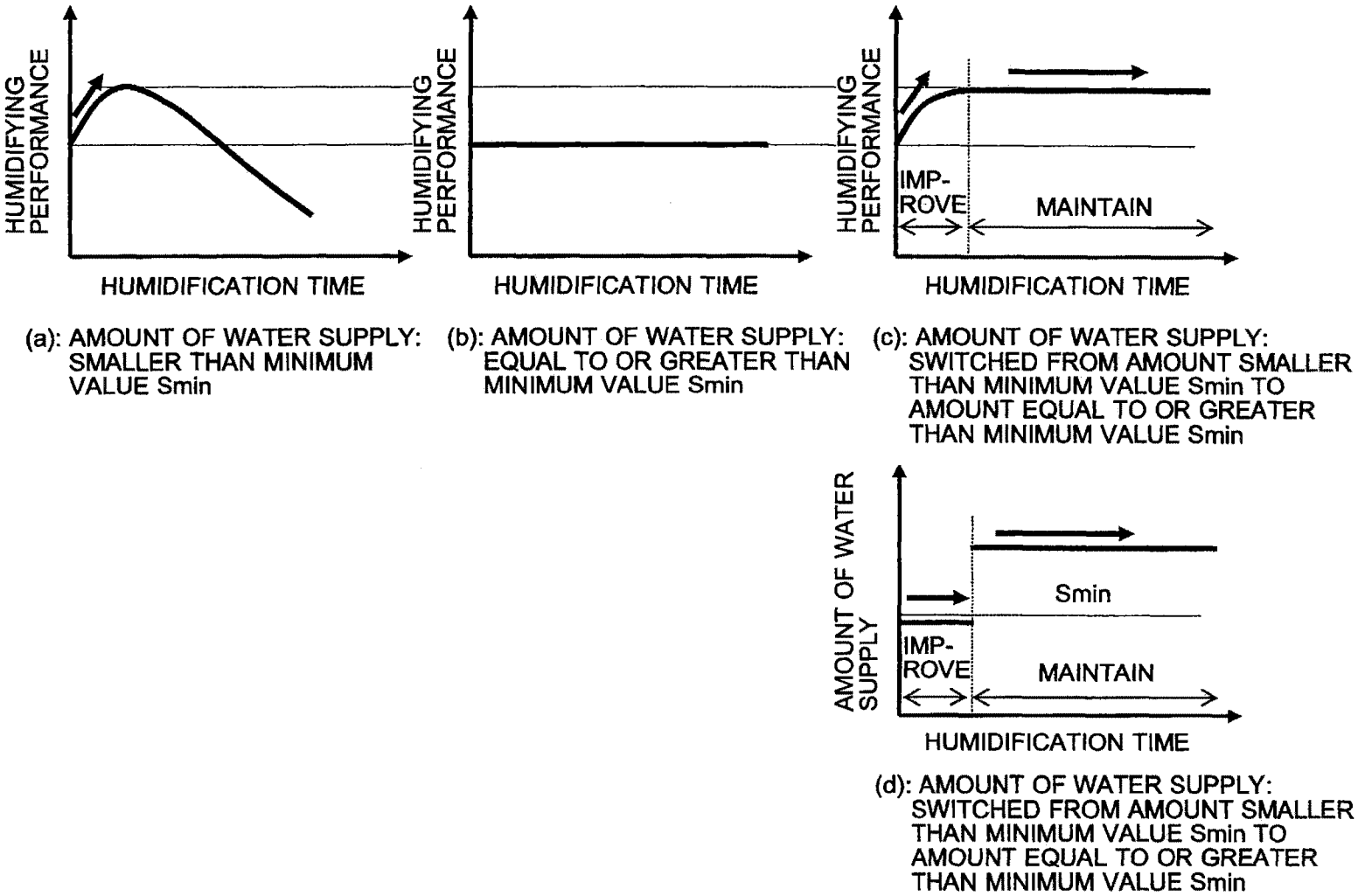
FIG. 3 includes diagrams illustrating a control method for the humidifier according to Embodiment 1.

FIG. 3 illustrates the control method for the humidifier according to Embodiment 1.

FIG. 3(*a*) illustrates the relationship between the humidifying performance and the humidification time in the case where the amount of water supply is smaller than the minimum value Smin. Here, the amount of water supply represents the amount of water supplied by the water supply unit 3 to the humidifying material 1 per preset time (for example, per unit time).

As illustrated in FIG. 3(*a*), the inventors found that, when operating with the amount of water supply smaller than the minimum value Smin, although the humidifying performance degrades in a long term due to accumulation of scales, the humidifying performance increases once at an initial stage.

It is inferred that at the initial stage, due to the start of deposition of a scale component, the surface area of the humidifying material 1 is increased, and the hydrophilization of the humidifying material 1 is improved, resulting in an increase in the water holding capacity.

FIG. 3(*b*) illustrates the relationship between the humidifying performance and the humidification time in the case where the amount of water supply is equal to or greater than the minimum value Smin.

As illustrated in FIG. 3(*b*), the inventors found that when operating with the amount of water supply equal to or greater than the minimum value Smin, the humidifying performance can be maintained.

It is inferred that supplying an amount of water equal to or greater than the minimum value Smin, which provides the humidifying material 1 with the maximum amount of humidification, suppresses concentration of the scale component of the humidifying material 1 and prevents scales from being deposited.

The inventors found a method for controlling the humidifying performance as described below.

FIG. 3(*c*) illustrates the relationship between the humidifying performance and the humidification time in the case where the amount of water supply is switched.

FIG. 3(*d*) illustrates the relationship between the amount of water supply and the humidification time in the case where the amount of water supply is switched.

As illustrated in FIGS. 3(*c*) and 3(*d*), at the initial stage, the amount of water supply is controlled to be smaller than the minimum value Smin. Accordingly, the scale component is actively deposited on the humidifying material 1 and the surface area of the humidifying material 1 is increased. Thus, the hydrophilization of the humidifying material 1 is improved and the water holding capacity is increased. As a result, the humidifying performance is enhanced.

After the humidifying performance is enhanced, the amount of water supply is switched to be equal to or greater than the minimum value Smin. Accordingly, concentration of the scale component is suppressed and scales are prevented from being deposited. Thus, the humidifying performance can be maintained.

At the initial stage, after the amount of water supply is controlled to be smaller than or equal to the minimum value Smin and the humidifying performance is enhanced, the amount of water supply may be switched to exceed the minimum value Smin. The amount of water supply after the switching only needs to exceed the minimum value Smin. Preferably, the concentration ratio of water is controlled to 2 or below.

Thus, unlike existing hydrophilic treatment, hydrophilic treatment using a scale component is less prone to deteriorate and therefore allows hydrophilization to be maintained for a long period of time.

Next, a control operation of the humidifier according to Embodiment 1 will be specifically described.

As illustrated in FIG. 2, the humidifier includes the first temperature and humidity sensor 10*a* and the second temperature and humidity sensor 10*b*.

The controller 9 obtains, based on detection values of the first temperature and humidity sensor 10*a* and the second temperature and humidity sensor 10*b*, the amount of humidification, which is the amount of water evaporated by the humidifying material 1 per preset time.

An example of a method for calculating the amount of humidification will be described below. That is, first, the amount of water in air per unit volume before humidification is obtained from the temperature and humidity detected by the first temperature and humidity sensor 10*a*. Then, the amount of water in air per unit volume after humidification is obtained from the temperature and humidity detected by the second temperature and humidity sensor 10*b*. Based on the difference between the amount of water in air before humidification and the amount of water in air after humidification, the amount of change of water is obtained. A value obtained by multiplying the amount of change by a coefficient, which is preset according to the volume and material of the humidifying material 1, the wind speed, the air blowing temperature, the supply water temperature, and the like, is defined as the amount of humidification.

The amount of humidification may be the average of multiple values obtained by at least two or more measurements. In such a case, it is preferable to employ an average value with which the variation in measurement is less than ±5%.

The controller 9 repeatedly performs calculation of the amount of humidification.

When the amount of humidification obtained at the present time is increased compared to the amount of humidification obtained at the previous time, the controller 9 controls the amount of water supplied by the water supply unit 3 per preset time (for example, per unit time) to be smaller than the minimum value Smin. The controller 9 stores in advance the value of the minimum value Smin. The value of the minimum value Smin may be a value obtained in advance according to the volume, material, and the like of the humidifying material 1, or a value measured in advance.

On the other hand, when the amount of humidification obtained at the present time is decreased compared to the amount of humidification obtained at the previous time or when the amount of humidification obtained at the present time is equal to the amount of humidification obtained at the previous time, the controller 9 controls the amount of water supplied by the water supply unit 3 per preset time (for example, per unit time) to be equal to or greater than the minimum value Smin. For example, the amount of water supplied by the water supply unit 3 is controlled to be equal to or greater than the minimum value Smin so that the water concentration ratio is 2 or below.

Figure 11:
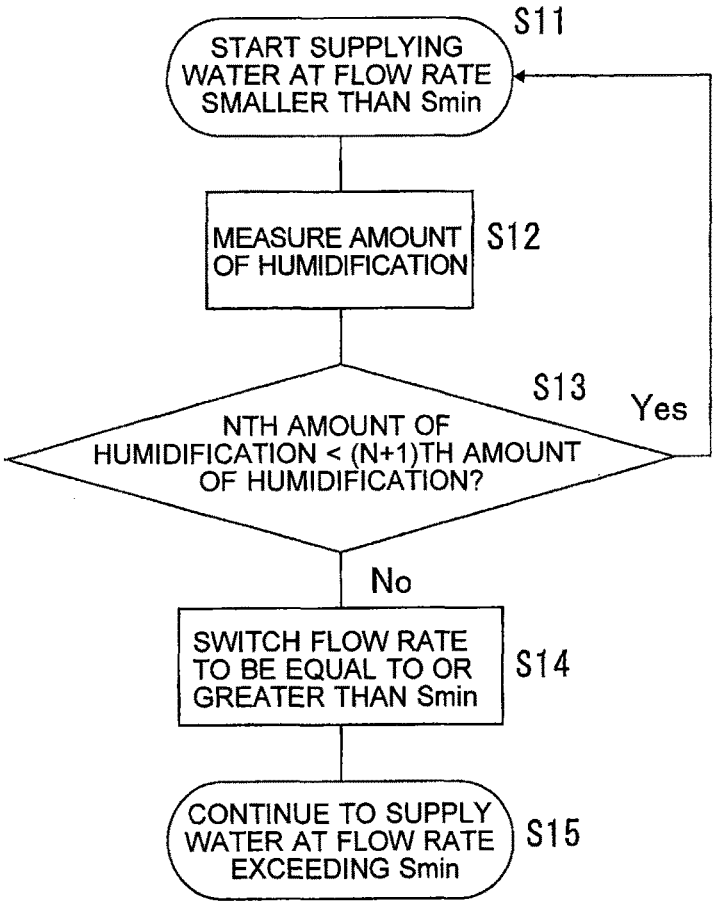
FIG. 11 is a flowchart illustrating a control method for the humidifier according to Embodiment 1.

FIG. 11 is a flowchart illustrating a control operation of the humidifier according to Embodiment 1.

An example of the control operation of the controller 9 will be described with reference to FIG. 11.

The controller 9 starts supplying water to the humidifying material 1 by controlling the amount of water supplied by the water supply unit 3 to be smaller than the minimum value Smin (S11).

The controller 9 obtains the amount of humidification, which is the amount of water evaporated by the humidifying material 1, by the above-described method (S12). The controller 9 compares the amount of humidification obtained at the previous time (the Nth amount of humidification) with the amount of humidification obtained at the present time (the (N+1)th amount of humidification) (S13). When the amount of humidification obtained at the present time (the (N+1)th amount of humidification) is greater than the amount of humidification obtained at the previous time (S13; Yes), the process returns to S11. Thus, when the amount of humidification obtained at the present time is increased compared to the amount of humidification obtained at the previous time, the amount of water supplied by the water supply unit 3 is smaller than the minimum value Smin. Thus, the means for causing the water supply unit to supply water to the humidifying material at a flow rate smaller than a minimum value of the amount of water providing the humidifying material with a maximum amount of humidification comprises steps S13 and S11 (as well as the subsequently described steps S81 and S83, S93 and S91; S103 and S101; S113 and S111).

In contrast, when the amount of humidification obtained at the present time (the (N+1)th amount of humidification) is not greater than the amount of humidification obtained at the previous time (S13; No), the process proceeds to S14.

The controller 9 switches the amount of water supplied by the water supply unit 3 to be equal to or greater than the minimum value Smin (S14). After that, the controller 9 continues to supply water while maintaining the state in which the amount of water supplied by the water supply unit 3 exceeds the minimum value Smin (S15). Thus, means for subsequently causing the water supply unit to supply water to the humidifying material at a flow rate equal to or exceeding the minimum value comprise steps S13 and S14 (as well as the subsequently described steps S83-S84; S93-S94; S103-S104; S113-S114).

In the above description, the amount of water supplied by the water supply unit 3 is switched to be smaller than the minimum value Smin or to be equal to or greater than the minimum value Smin. However, the switching is not limited to this. The amount of water supplied by the water supply unit 3 may be switched to be smaller than or equal to the minimum value Smin or to exceed the minimum value Smin.

The above control method will be described below with reference to FIG. 12.

Figure 12:
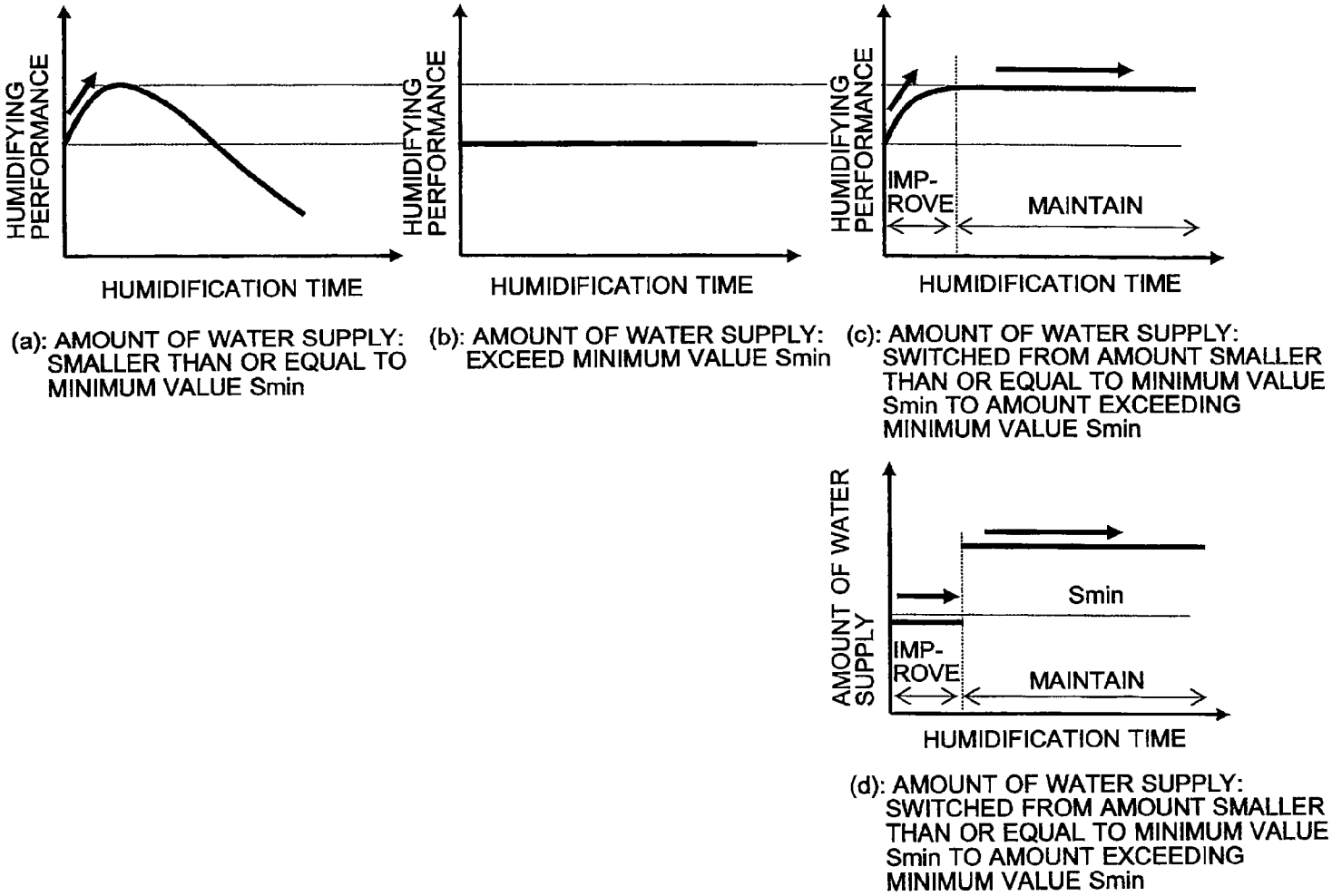
FIG. 12 includes diagrams illustrating a control method for the humidifier according to Embodiment 1.

FIG. 12 is a diagram illustrating the method for controlling the humidifier according to Embodiment 1.

FIG. 12(*a*) illustrates the relationship between the humidifying performance and the humidification time in the case where the amount of water supply is smaller than or equal to the minimum value Smin.

As illustrated in FIG. 12(*a*), the inventors found that, when operating with the amount of water supply smaller than or equal to the minimum value Smin, although the humidifying performance degrades in a long term due to accumulation of scales, the humidifying performance increases once at an initial stage.

It is inferred that at the initial stage, due to the start of deposition of a scale component, the surface area of the humidifying material 1 is increased, and the hydrophilization of the humidifying material 1 is improved, resulting in an increase in the water holding capacity.

FIG. 12(*b*) illustrates the relationship between the humidifying performance and the humidification time in the case where the amount of water supply exceeds the minimum value Smin.

As illustrated in FIG. 12(*b*), the inventors confirmed that, when operating with the amount of water supply exceeding the minimum value Smin, the humidifying performance can be maintained.

It is inferred that supplying an amount of water exceeding the minimum value Smin, which provides the humidifying material 1 with the maximum amount of humidification, causes suppression of concentration of the scale component of the humidifying material 1, and prevents scales from being deposited.

Therefore, as illustrated in FIG. 12, when the amount of humidification obtained at the present time is increased compared to the amount of humidification obtained at the previous time, the controller 9 controls the amount of water supplied by the water supply unit 3 to be smaller than or equal to the minimum value Smin. Further, when the amount of humidification obtained at the present time is decreased compared to the amount of humidification obtained at the previous time or when the amount of humidification obtained at the present time is equal to the amount of humidification obtained at the previous time, the controller 9 may control the amount of water supplied by the water supply unit 3 to exceed the minimum value Smin.

In the above description, the case where the amount of water supplied by the water supply unit 3 is switched when the amount of humidification obtained at the present time is not greater than the amount of humidification obtained at the previous time (S13; No) has been explained. However, the present invention is not limited to this. The controller 9 may control the amount of water supplied by the water supply unit 3 to exceed the minimum value Smin while the amount of humidification is decreasing to the initial amount of humidification after the amount of humidification obtained at the present time increases.

In Embodiment 1, the case where control of switching the amount of water supply is performed according to increase or decrease of the amount of humidification has been explained. However, the present invention is not limited to this. For example, the switching of the amount of water supply may be performed when the number of operations of the humidifier exceeds a preset number of times.

Alternatively, the switching of the amount of water supply may be performed when the integrated value of the amounts of water supplied from the water supply unit 3 to the humidifying material 1 exceeds a preset amount.

Figure 13:
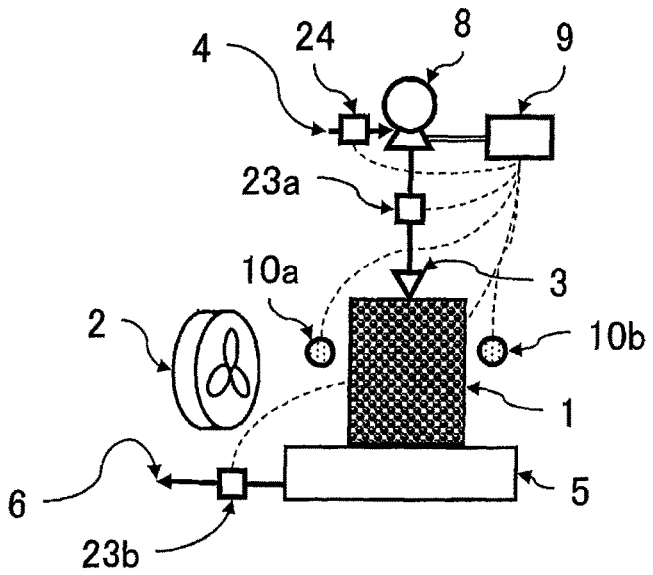
FIG. 13 is a diagram illustrating a configuration of humidifiers according to Embodiments 1 and 11.

Further, as illustrated in FIG. 13, the configuration illustrated in FIG. 2 may further include a first electric conductivity meter 23*a* which detects the electric conductivity of water to be supplied to the humidifying material 1, and a second electric conductivity meter 23*b* which detects the electric conductivity of water drained through the drain pan 5. When the amount of attached scales accumulated on the humidifying material 1 exceeds a preset amount of attached scales, the switching of the amount of water supply may be performed.

The amount of attached scales accumulated on the humidifying material 1 is obtained, for example, from a change in the weight of the humidifying material 1. Further, the amount of attached scales may be calculated while operating, for example, based on the amount of water supply, the amount of humidification, a concentration ratio calculated from the amount of water supply and the amount of humidification, electric conductivities of supplied water and drained water, the water holding capacity of the humidifying material 1, the number of drying times of the humidifying material 1, the saturated dissolved concentration of the scale component, and the concentration of the scale component during the water supply.

Instead of calculation while operating, the amount of attached scales accumulated can be estimated before operation, based on the water quality of water to be supplied, the initial amount of humidification, the amount of water supply, and the operation time. Therefore, the amount of water supply may be switched by setting a duration of time required for the amount of attached scales to reach a preset amount.

Furthermore, since the covering rate of scales on the humidifying material 1 or the integral humidification time can be defined from an estimated amount of attached scales, the switching of the amount of water supply may be performed when a preset covering rate of scales or a preset integral humidification time is exceeded.

Figure 14:
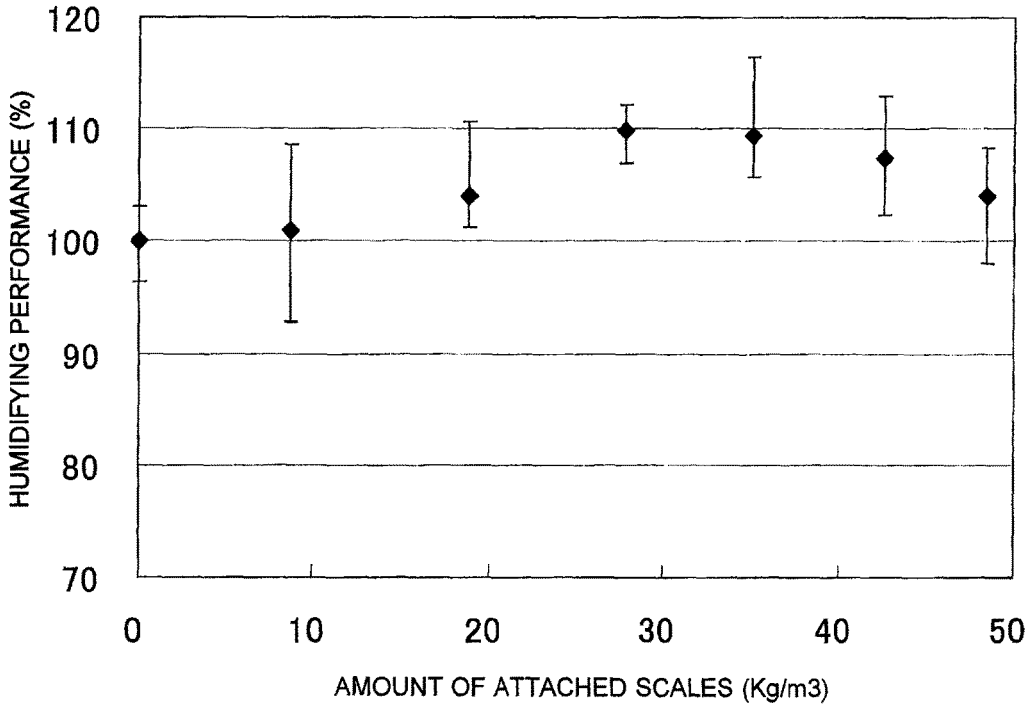
FIG. 14 is a diagram illustrating the correlation between the amount of attached scales and the humidifying performance.

A preset amount of attached scales is, although depending on the specifications of the humidifying material 1, as illustrated in FIG. 14 for example, preferably about 20 $kg/m^3$ to about 50 $kg/m^3$, or more preferably, around 30 $kg/m^3$, when a foam metal made of titanium with a porosity of 82% and a nominal hole diameter of 200 micrometers is used.

As illustrated in FIG. 14, when a foam metal made of titanium with a porosity of 82% and a nominal hole diameter of 200 micrometers is used as the humidifying material 1, the amount of humidification increases 1.1 times the initial amount of humidification with an amount of attached scales of around 30 $kg/m^3$.

As described above, according to Embodiment 1, by controlling the amount of water supplied by the water supply unit 3 to be smaller than the minimum value Smin, it is possible to perform hydrophilic treatment using a scale component and enhance the humidifying performance. Further, by controlling the amount of water supplied by the water supply unit 3 to be equal to or greater than the minimum value Smin, it is possible to suppress a degradation of the humidifying performance. Furthermore, hydrophilic treatment can be achieved using a scale component without performing expensive hydrophilic treatment in advance, and therefore an inexpensive humidifying material 1 can be obtained. In addition, since hydrophilic treatment using a scale component is less prone to deteriorate, hydrophilic treatment can be maintained, and a long-life humidifier capable of maintaining a high humidifying performance can be obtained.

Embodiment 2

In Embodiment 2, an aspect in which the hydrogen ion exponent (pH) of water to be supplied to a humidifying material 1 is increased so that deposition of scales, in particular, deposition of scales from a mineral component can be accelerated, will be explained.

Figure 4:
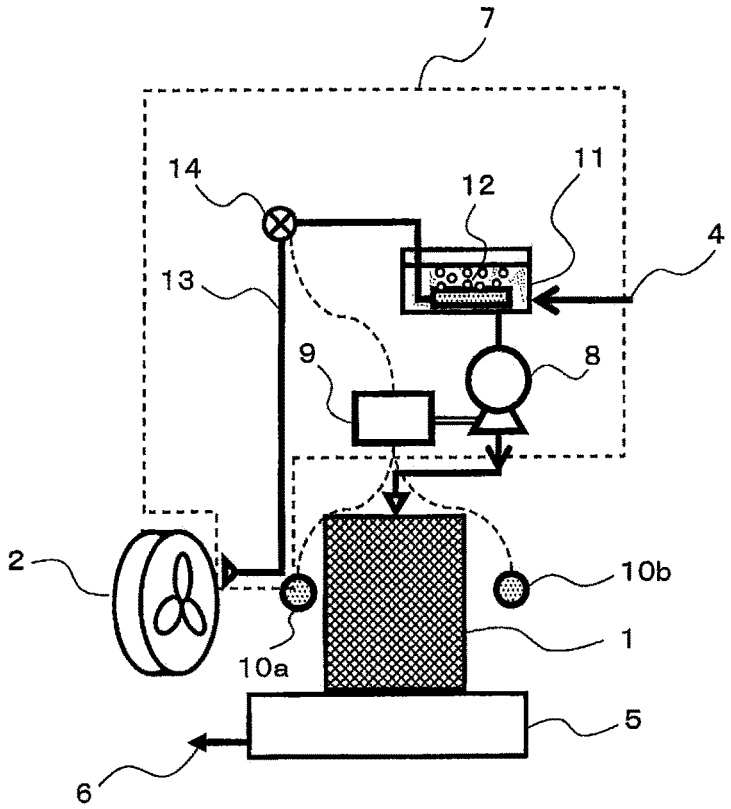
FIG. 4 is a diagram illustrating a configuration of a humidifier according to Embodiment 2.

FIG. 4 is a diagram illustrating a configuration of a humidifier according to Embodiment 2.

In FIG. 4, a humidifying performance control unit 7 according to Embodiment 2 includes a pump 8, a controller 9, a water tank 11, a diffuser tube 12, a ventilation pipe 13, and a solenoid valve 14.

The pump 8 delivers water from a water feeding unit 4 to a water supply unit 3. The controller 9 adjusts the flow rate of the pump 8 to control the amount of water supplied from the water supply unit 3 to the humidifying material 1. The water tank 11 is provided between the water feeding unit 4 and the pump 8. The water tank 11 stores water to be supplied to the humidifying material 1. The diffuser tube 12 is installed inside the water tank 11. The diffuser tube 12 is positioned inside the water tank 11 and supplies air to the water in the water tank 11. The ventilation pipe 13 blows part of air (wind) from a fan 2 to the diffuser tube 12. The solenoid valve 14 is provided in the middle of the ventilation pipe 13. The solenoid valve 14 switches between supply and non-supply of air from the diffuser tube 12. The solenoid valve 14 operates in conjunction with the controller 9. The solenoid valve 14 corresponds to an "opening/closing valve" according to the present invention.

The other features of the configuration are similar to those in Embodiment 1 described above. Furthermore, as in Embodiment 1 described above, the controller 9 performs switching control of the amount of water supply.

Next, an operation of the humidifying performance control unit 7 according to Embodiment 2 will be described.

Water supplied from the water feeding unit 4 is stored into the water tank 11.

The controller 9 obtains the amount of humidification, which is the amount of water evaporated by the humidifying material 1, per preset time, based on detection values of a first temperature and humidity sensor 10*a* and a second temperature and humidity sensor 10*b*. A method for calculating the amount of humidification is similar to that in Embodiment 1 described above.

The controller 9 calculates the amount of humidification repeatedly.

When the amount of humidification obtained at the present time is increased compared to the amount of humidification obtained at the previous time, the controller 9 controls the solenoid valve 14 to enter an opened state. When the solenoid valve 14 is in the opened state, part of the air blown from the fan 2 is supplied to the water in the water tank 11 through the diffuser tube 12. Accordingly, the water inside the water tank 11 is deaerated, the hydrogen ion exponent (pH) increases, and alkalinity with a pH value above 7 is attained. Increasing the pH value is able to accelerate deposition of scales, in particular, deposition of scales from a mineral component. In addition, the humidifying performance can be enhanced in a shorter time than Embodiment 1 described above.

In contrast, when the amount of humidification obtained at the present time is decreased compared to the amount of humidification obtained at the previous time or when the amount of humidification obtained at the present time is equal to the amount of humidification obtained at the previous time, the controller 9 controls the solenoid valve 14 to enter a closed state. When the solenoid valve 14 is in the closed state, air is not supplied from the diffuser tube 12, and deaeration of water inside the water tank 11 is stopped.

When the pH value is increased to near 9, scales may be deposited inside the water tank 11, depending on the quality of water. Therefore, it is desirable for the water inside the water tank 11 to have a pH value of more than 7 and less than 9. Preferably, the pH value exceeds 7 and below 8.5. For example, a pH meter for measuring the hydrogen ion exponent of the water inside the water tank 11 may be provided, and when the detected pH value exceeds 8.5, the controller 9 may control the solenoid valve 14 to enter the closed state. With this arrangement, the pH value is not increased until scales have been deposited.

As described above, in Embodiment 2, the hydrogen ion exponent (pH) of water to be supplied to the humidifying material 1 is increased, so that deposition of scales, in particular, deposition of scales from a mineral component, can be accelerated. Accordingly, the humidifying performance can be enhanced in a shorter time than Embodiment 1. Furthermore, hydrophilic treatment can be achieved using a scale component without performing expensive hydrophilic treatment in advance, and therefore an inexpensive humidifying material 1 can be obtained. In addition, since hydrophilic treatment using a scale component is less prone to deteriorate, hydrophilic treatment can be maintained, and a long-life humidifier capable of maintaining a high humidifying performance can be obtained.

Embodiment 3

In Embodiment 3, an aspect in which an ionic additive is added to water to be supplied to the humidifying material 1 so that deposition of scales is accelerated, will be described.

Figure 5:
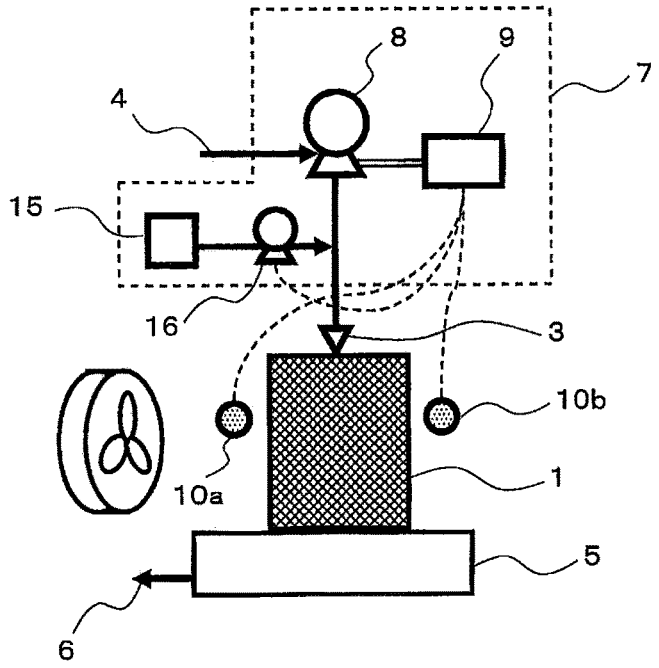
FIG. 5 is a diagram illustrating a configuration of a humidifier according to Embodiment 3.

FIG. 5 is a diagram illustrating a configuration of a humidifier according to Embodiment 3.

In FIG. 5, a humidifying performance control unit 7 according to Embodiment 3 includes a pump 8, a controller 9, a chemical liquid tank 15, and a chemical liquid addition pump 16.

The pump 8 delivers water from the water feeding unit 4 to the water supply unit 3. The controller 9 adjusts the flow rate of the pump 8 to control the amount of water to be supplied from the water supply unit 3 to the humidifying material 1. An ionic additive is stored inside the chemical liquid tank 15. The chemical liquid addition pump 16 delivers the ionic additive in the chemical liquid tank 15 to the water to be supplied to the humidifying material 1. The chemical liquid addition pump 16 operates in conjunction with the controller 9. The chemical liquid tank 15 and the chemical liquid addition pump 16 correspond to a "chemical liquid addition unit" according to the present invention.

Ion additives include an alkaline agent and an acidic agent.

Adding an alkaline agent increases the hydrogen ion exponent (pH) of water to be supplied to the humidifying material 1, and is therefore able to accelerate deposition of scales from a mineral component. Alkaline agents include, for example, solutions of sodium hydroxide, potassium hydroxide, calcium hydroxide, sodium carbonate, sodium acid carbonate, and the like. The alkaline agent corresponds to an "ionic additive" according to the present invention.

In contrast, adding an acidic agent decreases the hydrogen ion exponent (pH) of water to be supplied to the humidifying material 1, and is therefore able to accelerate deposition of scales from a silica component. The acidic agent corresponds to an "ionic additive" according to the present invention.

The other features of the configuration are similar to those in Embodiment 1 described above. Furthermore, as in Embodiment 1 described above, the controller 9 performs switching control of the amount of water supply.

Next, an operation of the humidifying performance control unit 7 according to Embodiment 3 will be described.

Water supplied from the water feeding unit 4 is supplied from the water supply unit 3 to the humidifying material 1 by the pump 8.

The controller 9 obtains the amount of humidification, which is the amount of water evaporated by the humidifying material 1, per preset time, based on detection values of a first temperature and humidity sensor 10*a* and a second temperature and humidity sensor 10*b*. A method for calculating the amount of humidification is similar to that in Embodiment 1 described above.

The controller 9 calculates the amount of humidification repeatedly.

When the amount of humidification obtained at the present time is increased compared to the amount of humidification obtained at the previous time, the controller 9 causes the chemical liquid addition pump 16 to operate to supply the ionic additive in the chemical liquid tank 15 to the water delivered through the pump 8. Accordingly, in the case where the ionic additive is an alkaline agent, the hydrogen ion exponent (pH) increases, and alkalinity with a pH value above 7 is attained. Increasing the pH value is able to accelerate deposition of scales from a mineral component. In the case where the ionic additive is an acidic agent, the hydrogen ion exponent (pH) decreases, and acidity with a pH value below 7 is attained. Decreasing the pH value is able to accelerate deposition of scales from a silica component. Consequently, the humidifying performance can be enhanced in a shorter time than Embodiment 1 described above.

In contrast, when the amount of humidification obtained at the present time is decreased compared to the amount of humidification obtained at the previous time or when the amount of humidification obtained at the present time is equal to the amount of humidification obtained at the previous time, the controller 9 stops the chemical liquid addition pump 16 to stop supplying an ionic additive.

When the pH value is increased to near 9, the amount of deposition of scales is too large, depending on the quality of water, and clogging may occur in the humidifying material 1. Therefore, it is desirable for the alkaline agent as an ionic additive to have a pH value of more than 7 and less than 9. Preferably, the pH value exceeds 7 and below 8.5. For example, the amount of alkaline agent to be supplied from the chemical liquid addition pump 16 per unit time may be adjusted in accordance with the amount of water to be supplied from the pump 8 per unit time. That is, control is performed to attain a desired pH value by decreasing the amount of alkaline agent to be supplied when the flow rate of the pump 8 is low, and by increasing the amount of alkaline agent to be supplied when the flow rate of the pump 8 is high.

As described above, in Embodiment 3, with addition of an ionic additive to water to be supplied to the humidifying material 1, the hydrogen ion exponent (pH) is able to be increased or decreased, so that deposition of scales can be accelerated. Accordingly, the humidifying performance can be enhanced in a shorter time than Embodiment 1. Furthermore, hydrophilic treatment can be achieved using a scale component without performing expensive hydrophilic treatment in advance, and therefore an inexpensive humidifying material 1 can be obtained. In addition, since hydrophilic treatment using a scale component is less prone to deteriorate, hydrophilic treatment can be maintained, and a long-life humidifier capable of maintaining a high humidifying performance can be obtained.

Embodiment 4

In Embodiment 4, an aspect in which increasing the temperature of water to be supplied to the humidifying material 1 accelerates deposition of scales, will be described.

Figure 6:
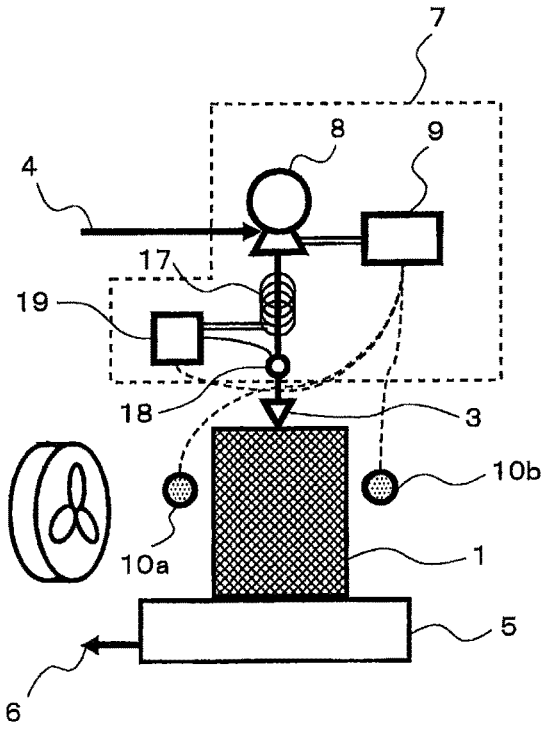
FIG. 6 is a diagram illustrating a configuration of a humidifier according to Embodiment 4.

FIG. 6 is a diagram illustrating a configuration of a humidifier according to Embodiment 4.

In FIG. 6, the humidifying performance control unit 7 according to Embodiment 4 includes a pump 8, a controller 9, a heater 17, a temperature sensor 18, and a temperature adjusting device 19.

The pump 8 delivers water from the water feeding unit 4 to the water supply unit 3. The controller 9 adjusts the flow rate of the pump 8 to control the amount of water to be supplied from the water supply unit 3 to the humidifying material 1. The heater 17 heats water to be supplied to the humidifying material 1. The temperature sensor 18 detects the temperature of water to be supplied to the humidifying material 1. The temperature adjusting device 19 drives the heater 17. The temperature adjusting device 19 operates in conjunction with the controller 9. The heater 17 corresponds to a "heating unit" according to the present invention.

The other features of the configuration are similar to those in Embodiment 1 described above. Furthermore, as in Embodiment 1 described above, the controller 9 performs switching control of the amount of water supply.

Next, an operation of the humidifying performance control unit 7 according to Embodiment 4 will be described.

Water supplied from the water feeding unit 4 is supplied from the water supply unit 3 to the humidifying material 1 by the pump 8.

The controller 9 obtains the amount of humidification, which is the amount of water evaporated by the humidifying material 1, per preset time, based on detection values of a first temperature and humidity sensor 10*a* and a second temperature and humidity sensor 10*b*. A method for calculating the amount of humidification is similar to that in Embodiment 1 described above.

The controller 9 calculates the amount of humidification repeatedly.

When the amount of humidification obtained at the present time is increased compared to the amount of humidification obtained at the previous time, the controller 9 drives the temperature adjusting device 19 to cause the heater 17 to heat water. Accordingly, the water to be supplied to the humidifying material 1 is raised to at least the normal temperature or more. Increasing the temperature of water is able to accelerate deposition of scales, in particular, deposition of scales from a mineral component. Consequently, the humidifying performance can be enhanced in a shorter time than Embodiment 1 described above.

In contrast, when the amount of humidification obtained at the present time is decreased compared to the amount of humidification obtained at the previous time or when the amount of humidification obtained at the present time is equal to the amount of humidification obtained at the previous time, the controller 9 stops the driving of the temperature adjusting device 19 to stop heating by the heater 17.

When the temperature of water to be supplied to the humidifying material 1 is raised to 100 degrees Centigrade, scales may be deposited before the water is supplied to the humidifying material 1, depending on the concentration of a mineral component contained in the water. Therefore, it is desirable for the water to be heated by the heater 17 at a temperature lower than 100 degrees Centigrade. Preferably, the temperature is equal to or higher than the normal temperature and lower than or equal to 50 degrees Centigrade. For example, when the temperature of the water, based on a detected value of the temperature sensor 18 exceeds 50 degrees Centigrade, the temperature adjusting device 19 may stop the driving of the heater 17.

As described above, in Embodiment 4, the temperature of water to be supplied to the humidifying material 1 is increased, so that deposition of scales, in particular, deposition of scales from a mineral component can be accelerated. Accordingly, the humidifying performance can be enhanced in a shorter time than Embodiment 1. Furthermore, hydrophilic treatment can be achieved using a scale component without performing expensive hydrophilic treatment in advance, and therefore an inexpensive humidifying material 1 can be obtained. In addition, since hydrophilic treatment using a scale component is less prone to deteriorate, hydrophilic treatment can be maintained, and a long-life humidifier capable of maintaining a high humidifying performance can be obtained.

Embodiment 5

In Embodiment 5, an aspect in which a chemical agent is added to water to be supplied to the humidifying material 1 so that deposition of scales can be accelerated, will be described.

Figure 7:
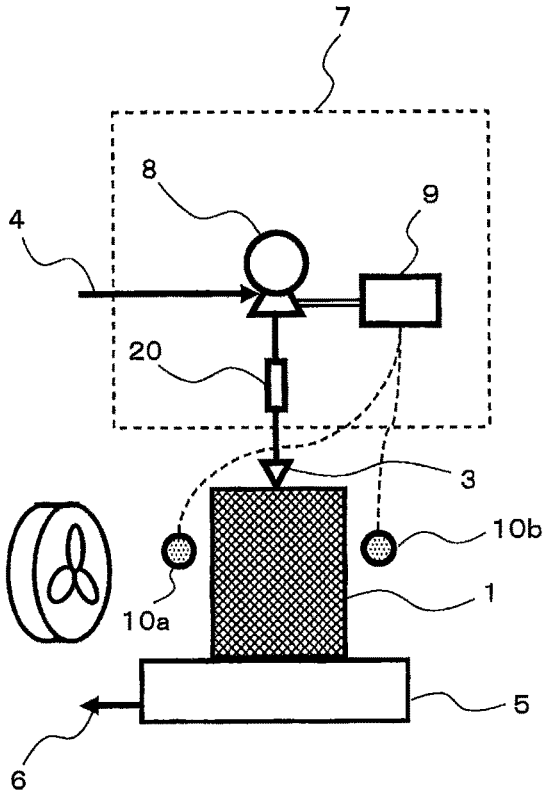
FIG. 7 is a diagram illustrating a configuration of a humidifier according to Embodiment 5.

FIG. 7 is a diagram illustrating a configuration of a humidifier according to Embodiment 5.

In FIG. 7, the humidifying performance control unit 7 according to Embodiment 5 includes a pump 8, a controller 9, and a chemical agent filling cylinder 20.

The pump 8 delivers water from the water feeding unit 4 to the water supply unit 3. The controller 9 adjusts the flow rate of the pump 8 to control the amount of water to be supplied from the water supply unit 3 to the humidifying material 1. The chemical agent filling cylinder 20 supplies a chemical agent to the water to be supplied to the humidifying material 1. The chemical agent filling cylinder 20 corresponds to a "chemical agent filling unit" according to the present invention.

A chemical agent supplied to water by the chemical agent filling cylinder 20 is capable of increasing the concentration of a seed crystal which accelerates deposition of a scale component or the concentration of the scale component, compared to the concentration of water to be supplied. This chemical agent may be, for example, powder of calcium carbonate, calcium hydrogencarbonate, silica gel, or the like. The amount of filling to the chemical agent filling cylinder 20 may be small, such as several milligrams to several grams.

The other features of the configuration are similar to those in Embodiment 1 described above. Furthermore, as in Embodiment 1 described above, the controller 9 performs switching control of the amount of water supply.

Next, an operation of the humidifying performance control unit 7 according to Embodiment 5 will be described.

Water supplied from the water feeding unit 4 is supplied from the water supply unit 3 to the humidifying material 1 by the pump 8.

At this time, by causing water from the pump 8 to flow to the chemical agent filling cylinder 20, water containing a chemical agent or water with a dissolved chemical agent is supplied to the humidifying material 1. The chemical agent continues to be supplied until the chemical agent in the chemical agent filling cylinder 20 has become empty. Accordingly, deposition of scales on the surface of the humidifying material 1 can be accelerated. Consequently, the humidifying performance can be enhanced in a shorter time than Embodiment 1 described above.

Supply or non-supply of a chemical agent from the chemical agent filling cylinder 20 may be controlled by the controller 9. A specific example will be explained below.

The controller 9 obtains the amount of humidification, which is the amount of water evaporated by the humidifying material 1, per preset time, based on detection values of a first temperature and humidity sensor 10*a* and a second temperature and humidity sensor 10*b*. A method for calculating the amount of humidification is similar to that in Embodiment 1 described above.

The controller 9 calculates the amount of humidification repeatedly.

When the amount of humidification obtained at the present time is increased compared to the amount of humidification obtained at the previous time, the controller 9 causes a chemical agent to be supplied from the chemical agent filling cylinder 20.

In contrast, when the amount of humidification obtained at the present time is decreased compared to the amount of humidification obtained at the previous time or when the amount of humidification obtained at the present time is equal to the amount of humidification obtained at the previous time, the controller 9 stops supplying a chemical agent from the chemical agent filling cylinder 20.

As described above, in Embodiment 5, since a chemical agent is added to the water to be supplied to the humidifying material 1, deposition of scales can be accelerated. Accordingly, the humidifying performance can be enhanced in a shorter time than Embodiment 1. Furthermore, hydrophilic treatment can be achieved using a scale component without performing expensive hydrophilic treatment in advance, and therefore an inexpensive humidifying material 1 can be obtained. In addition, since hydrophilic treatment using a scale component is less prone to deteriorate, hydrophilic treatment can be maintained, and a long-life humidifier capable of maintaining a high humidifying performance can be obtained.

Embodiment 6

In Embodiment 6, an aspect in which the configuration of the humidifying performance control unit 7 according to Embodiment 2 and the configuration of the humidifying performance control unit 7 according to Embodiment 4 are combined together, will be described.

Figure 8:
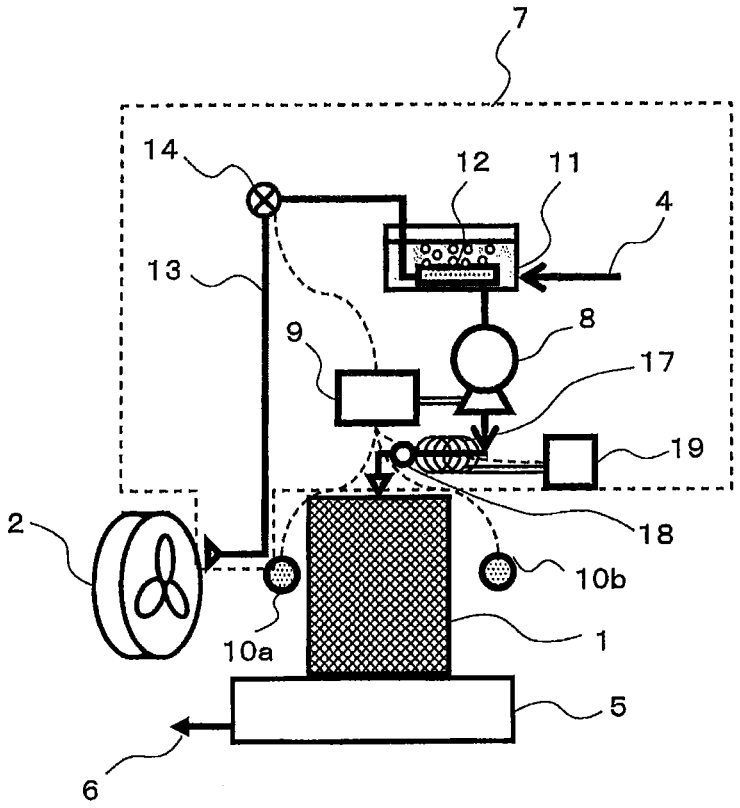
FIG. 8 is a diagram illustrating a configuration of a humidifier according to Embodiment 6.

FIG. 8 is a diagram illustrating a configuration of a humidifier according to Embodiment 6.

In FIG. 8, a humidifying performance control unit 7 according to Embodiment 6 includes a pump 8, a controller 9, a water tank 11, a diffuser tube 12, a ventilation pipe 13, a solenoid valve 14, a heater 17, a temperature sensor 18, and a temperature adjusting device 19. The individual configurations are similar to those in Embodiment 2 and Embodiment 4 described above.

The other features of the configuration are similar to those in Embodiment 1 described above. Furthermore, as in Embodiment 1 described above, the controller 9 performs switching control of the amount of water supply.

Next, an operation of the humidifying performance control unit 7 according to Embodiment 6 will be described.

Water supplied from the water feeding unit 4 is stored into the water tank 11, as in Embodiment 2 described above.

The controller 9 obtains the amount of humidification, which is the amount of water evaporated by the humidifying material 1, per preset time, based on detection values of a first temperature and humidity sensor 10*a* and a second temperature and humidity sensor 10*b*. A method for calculating the amount of humidification is similar to that in Embodiment 1 described above.

The controller 9 calculates the amount of humidification repeatedly.

When the amount of humidification obtained at the present time is increased compared to the amount of humidification obtained at the previous time, the controller 9 controls the solenoid valve 14 to enter an opened state. The controller 9 also drives the temperature adjusting device 19 to cause the heater 17 to heat the water. Accordingly, the water inside the water tank 11 is deaerated, the hydrogen ion exponent (pH) increases, and alkalinity with a pH value above 7 is attained. Furthermore, the water to be supplied to the humidifying material 1 is raised to at least the normal temperature or more. Therefore, deposition of scales, in particular, deposition of scales from a mineral component can be more accelerated than Embodiment 2 or Embodiment 4. Consequently, the humidifying performance can be enhanced in a shorter time than Embodiment 2 or Embodiment 4 described above.

In contrast, when the amount of humidification obtained at the present time is decreased compared to the amount of humidification obtained at the previous time or when the amount of humidification obtained at the present time is equal to the amount of humidification obtained at the previous time, the controller 9 controls the solenoid valve 14 to enter a closed state. The controller 9 also stops the driving of the temperature adjusting device 19 to stop heating by the heater 17.

As described above, in Embodiment 6, deposition of scales, in particular, deposition of scales from a mineral component can be more accelerated than Embodiment 2 or Embodiment 4. Accordingly, the humidifying performance can be enhanced in a shorter time than Embodiment 2 or Embodiment 4. Furthermore, hydrophilic treatment can be achieved using a scale component without performing expensive hydrophilic treatment in advance, and therefore an inexpensive humidifying material 1 can be obtained. In addition, since hydrophilic treatment using a scale component is less prone to deteriorate, hydrophilic treatment can be maintained, and a long-life humidifier capable of maintaining a high humidifying performance can be obtained.

Although an aspect in which the configuration of the humidifying performance control unit 7 according to Embodiment 2 described above and the configuration of the humidifying performance control unit 7 according to Embodiment 4 described above are combined together has been described in Embodiment 6, the present invention is not limited to this. At least two or more of the configurations according to Embodiments 2 to 5 described above my be combined together. By combining multiple configurations, deposition of scales, in particular, depositions of scales from a mineral component can further be accelerated.

After the humidifying performance is enhanced, the humidifying performance control unit 7 described above in Embodiments 1 to 6 may be removed from the humidifier main body. Furthermore, the removed humidifying performance control unit 7 may be attached to a different humidifier.

Embodiment 7

Aspects in which a scale component is attached at the beginning of the operation of a humidifier and hydrophilic treatment is performed, have been described in Embodiments 1 to 6. In Embodiment 7, an aspect in which a humidifier includes a humidifying material 1 on which a scale component is attached and hydrophilic treatment is performed in advance, will be described.

The humidifier according to Embodiment 7 includes the humidifying material 1 on which hydrophilic treatment was performed in a manufacturing process. The other features of the configuration are similar to those in Embodiment 1 described above. A process of a method of hydrophilic treatment for the humidifying material 1 will be described below.

The method of hydrophilic treatment for the humidifying material 1 has a process similar to that of hydrophilic treatment using a scale component according to Embodiment 1 described above.

That is, first, water is supplied to the humidifying material 1, and air is blown to the humidifying material 1. Next, the temperature and humidity of the air before passing through the humidifying material 1 and the temperature and humidity of the air after passing through the humidifying material 1 are detected. Then, based on detection values of the temperature and humidity, the amount of humidification, which is the amount of water evaporated by the humidifying material 1, per preset time is obtained. A method for calculating the amount of humidification is similar to that in Embodiment 1 described above. Next, while the amount of humidification obtained at the present time is increasing compared the amount of humidification obtained at the previous time, the amount of water supplied to the humidifying material 1 per the preset time is controlled to be smaller than a minimum value Smin.

Although a case where a method of hydrophilic treatment for the humidifying material 1 has a process similar to that of the hydrophilic treatment according to Embodiment 1 described above has been explained in Embodiment 7, the present invention is not limited to this. A method of hydrophilic treatment may have at least one of or a combination of some of the processes of the hydrophilic treatment according to Embodiments 1 to 6.

Next, an operation of the humidifying performance control unit 7 according to Embodiment 7 will be described.

Water supplied from the water feeding unit 4 is supplied from the water supply unit 3 to the humidifying material 1 by the pump 8.

The controller 9 obtains the amount of humidification, which is the amount of water evaporated by the humidifying material 1, per preset time, based on detection values of a first temperature and humidity sensor 10*a* and a second temperature and humidity sensor 10*b*. A method for calculating the amount of humidification is similar to that in Embodiment 1 described above.

The controller 9 controls the amount of water supplied by the water supply unit 3 per preset time (for example, per unit time) to be equal to or greater than a minimum value Smin. Accordingly, by supplying an amount of water equal to or greater than the minimum value Smin, which is the minimum amount of water supply that provides the humidifying material 1 with the maximum amount of humidification, to the humidifying material 1, an increase in the concentration of a scale component of the humidifying material 1 is suppressed, and attachment of a scale component can be suppressed.

As described above, in Embodiment 7, the humidifying material 1 on which hydrophilic treatment using a scale component is performed in advance is provided, the humidifying performance can be enhanced. Furthermore, there is no need to perform expensive hydrophilic treatment in advance, and therefore an inexpensive humidifying material 1 can be obtained. In addition, since hydrophilic treatment using a scale component is less prone to deteriorate, hydrophilic treatment can be maintained, and a long-life humidifier capable of maintaining a high humidifying performance can be obtained. Moreover, by controlling the amount of water supplied by the water supply unit 3 to be equal to or greater than the minimum value Smin, it is possible to suppress a degradation of the humidifying performance.

Embodiment 8

In Embodiment 8, an aspect in which when the amount of humidification obtained at the present time is increased compared to the amount of humidification obtained at the previous time, a controller 9 controls the amount of water supplied by the water supply unit 3 to a minimum value Smin and controls the amount of water supplied by the water supply unit 3 to exceed the minimum value Smin while the amount of humidification is decreasing to the initial amount of humidification after the amount of humidification obtained at the present time is increased compared to the amount of humidification obtained at the previous time, will be described.

The configuration of a humidifier according to Embodiment 8 is similar to the configuration according to Embodiment 1 (FIG. 2) described above.

Next, an operation according to Embodiment 8 will be described.

Figure 15:
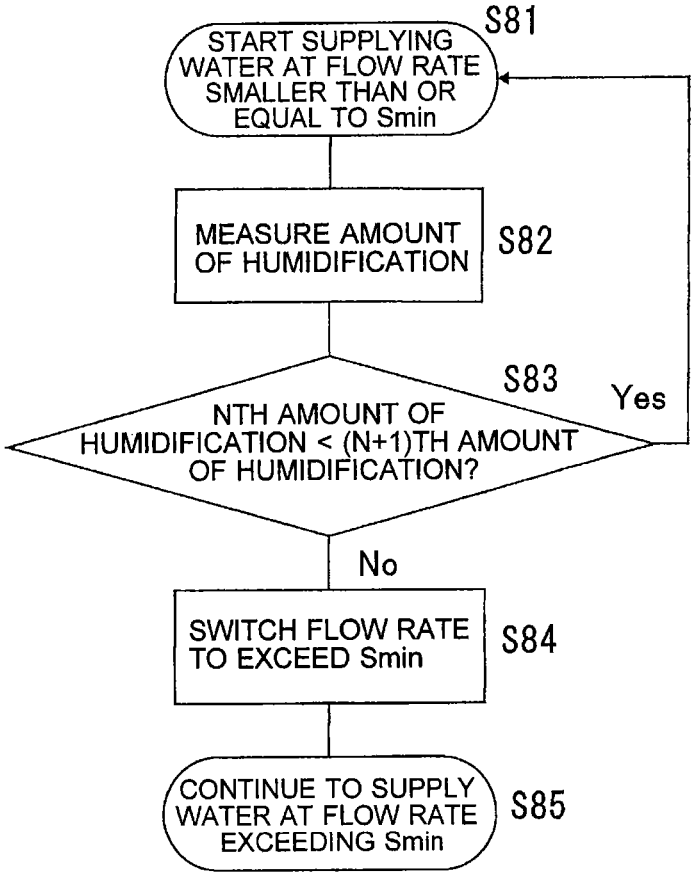
FIG. 15 is a flowchart illustrating a control operation of the humidifier according to Embodiment 8.

FIG. 15 is a flowchart illustrating a control operation of the humidifier according to Embodiment 8.

An example of the control operation of the controller 9 will be described with reference to FIG. 15.

The controller 9 starts supplying water to the humidifying material 1 by controlling the amount of water supplied by the water supply unit 3 to be smaller than or equal to the minimum value Smin (S81). For example, the amount of water supplied by the water supply unit 3 is controlled to the minimum value Smin.

In a method similar to that in Embodiment 1 described above, the controller 9 obtains the amount of humidification, which is the amount of water evaporated by the humidifying material 1 (S82). The controller 9 compares the amount of humidification obtained at the previous time (the Nth amount of humidification) with the amount of humidification obtained at the present time (the (N+1)th amount of humidification) (S83). When the amount of humidification obtained at the present time (the (N+1)th amount of humidification) is greater than the amount of humidification obtained at the previous time (S83; Yes), the process returns to S81. Accordingly, when the amount of humidification obtained at the present time is increased compared to the amount of humidification obtained at the previous time, the amount of water supplied by the water supply unit 3 is smaller than or equal to the minimum value Smin.

In contrast, when the amount of humidification obtained at the present time ((N+1)th amount of humidification) is not greater than the amount of humidification obtained at the previous time (S83; No), the process proceeds to S84. The controller 9 switches the amount of water supplied by the water supply unit 3 to an amount of supply which exceeds the minimum value Smin (S84). After that, the controller 9 continues to supply water while maintaining the state in which the amount of water supplied by the water supply unit 3 exceeds the minimum value Smin (S85). For example, the controller 9 controls the amount of water supplied by the water supply unit 3 per preset time (for example, per unit time) to exceed the minimum value Smin so that the concentration ratio of water is 2 or below. The other features of the operation are similar to those in Embodiment 1.

While the amount of humidification is decreasing to the initial amount of humidification after the amount of humidification obtained at the present time increases, the controller 9 may control the amount of water supplied by the water supply unit 3 to exceed the minimum value Smin.

As described above, in Embodiment 8, when the amount of humidification obtained at the present time is increased compared to the amount of humidification obtained at the previous time, the amount of water supply is controlled to be smaller than or equal to the minimum value Smin, and therefore the humidifying performance can be enhanced by an improvement in a state of surface area caused by attachment of scales. Furthermore, while the amount of humidification is decreasing to the initial amount of humidification after the amount of humidification obtained at the present time increases, the amount of water supply is controlled to exceed the minimum value Smin, and therefore a degradation of the humidifying performance can be suppressed by moderating concentration of a scale component on the humidifying material surface and suppressing attachment of scales. Accordingly, by performing control as in Embodiment 8, effects similar to those in Embodiment 1 can be achieved.

Embodiment 9

In Embodiment 9, an aspect in which in the case where the amount of humidification obtained at the present time is increased compared to the amount of humidification obtained at the previous time, the controller 9 controls the amount of water supplied by the water supply unit 3 to a minimum value Smin, and controls the amount of water supplied by the water supply unit 3 to exceed the minimum value Smin while the amount of humidification obtained at the present time is increasing compared to the amount of humidification obtained at the previous time, will be described.

As a humidifying material 1 of a humidifier according to Embodiment 8, a foam metal made of titanium with a porosity of 82% and a nominal hole diameter of 200 micrometers is used.

The other features of the configuration are similar to those in Embodiment 1 described above (FIG. 2).

Next, an operation according to Embodiment 9 will be described.

Figure 16:
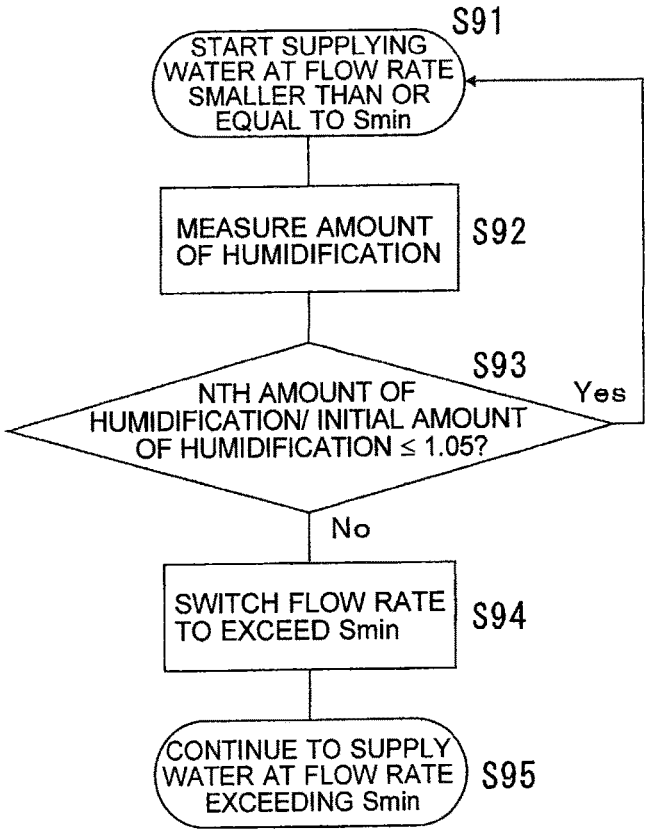
FIG. 16 is a flowchart illustrating a control operation of the humidifier according to Embodiment 9.

FIG. 16 is a flowchart illustrating a control operation of the humidifier according to Embodiment 9.

An example of the control operation of the controller 9 will be described with reference to FIG. 16.

The controller 9 starts supplying water to the humidifying material 1 by controlling the amount of water supplied by the water supply unit 3 to be smaller than or equal to the minimum value Smin (S91). For example, the amount of water supplied by the water supply unit 3 is controlled to the minimum value Smin.

In a method similar to that in Embodiment 1 described above, the controller 9 obtains the amount of humidification, which is the amount of water evaporated by the humidifying material 1 (S92). After starting water supply to the humidifying material 1, the controller 9 also stores the amount of humidification obtained first as an initial amount of humidification.

The controller 9 determines whether or not the rate of the amount of humidification obtained at the present time (the Nth amount of humidification) to the initial amount of humidification is smaller than or equal to 1.05 (S93). When the rate of the amount of humidification obtained at the present time (the Nth amount of humidification) to the initial amount of humidification is smaller than or equal to 1.05 (S93; Yes), the process returns to S91. Accordingly, when the amount of humidification is 1.05 times the initial amount of humidification or less, the amount of water supplied by the water supply unit 3 is smaller than or equal to the minimum value Smin.

In S93, the value to be compared with the rate of the amount of humidification obtained at the present time (the Nth amount of humidification) to the initial amount of humidification is not limited to 1.05. In S93, when the amount of humidification obtained at the present time exceeds the initial amount of humidification and reaches a desired amount of humidification, which is smaller than or equal to the maximum amount of humidification, the amount of water supply may be switched. For example, by hydrophilic treatment using a scale component, the amount of humidification is improved up to 1.1 times the initial amount of humidification. That is, the amount of water supplied by the water supply unit 3 may be controlled to the minimum value Smin or less until the rate of the amount of humidification obtained at the present time (the Nth amount of humidification) to the initial amount of humidification exceeds 1 and reaches a desired value smaller than or equal to 1.1.

In contrast, when the rate of the amount of humidification obtained at the present time (the Nth amount of humidification) to the initial amount of humidification is greater than 1.05 (S93; No), the process proceeds to S94. The controller 9 switches the amount of water supplied by the water supply unit 3 to an amount of supply which exceeds the minimum value Smin (S94). After that, the controller 9 continues to supply water while maintaining the state in which the amount of water supplied by the water supply unit 3 exceeds the minimum value Smin (S95). For example, the controller 9 controls the amount of water supplied by the water supply unit 3 per preset time (for example, per unit time) to exceed the minimum value Smin so that the concentration ratio of water is 2 or below. The other features of the operation are similar to those in Embodiment 1.

While the amount of humidification is decreasing to the initial amount of humidification after the amount of humidification obtained at the present time increases, the controller 9 may control the amount of water supplied by the water supply unit 3 to exceed the minimum value Smin.

As described above, in Embodiment 9, when the amount of humidification obtained at the present time is increased compared to the amount of humidification obtained at the previous time, by controlling the amount of water supply to be smaller than or equal to the minimum value Smin, the humidifying performance can be enhanced by an improvement in a state of surface area caused by attachment of scales. Furthermore, while the amount of humidification is increasing compared to the initial amount of humidification, by controlling the amount of water supply to exceed the minimum value Smin, a degradation of the humidifying performance can be suppressed by moderating concentration of a scale component on the humidifying material surface and suppressing attachment of scales. Accordingly, by performing control as in Embodiment 9, effects similar to those in Embodiment 1 can be achieved.

Embodiment 10

In Embodiment 10, an aspect in which the amount of water supply is switched based on the integrated value of water supplied from the water supply unit 3 to the humidifying material 1, will be described.

Figure 17:
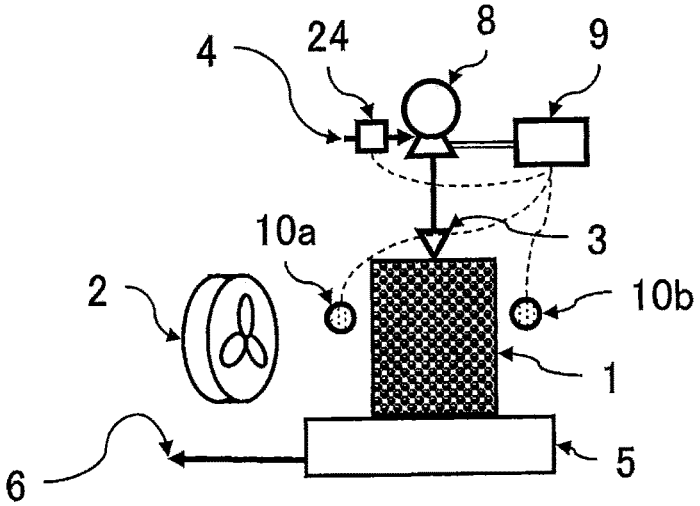
FIG. 17 is a diagram illustrating a configuration of a humidifier according to Embodiment 10.

FIG. 17 is a diagram illustrating a configuration of a humidifier according to Embodiment 10.

In FIG. 17, the humidifier according to Embodiment 10 includes a flowmeter 24, in addition to the configuration according to Embodiment 1 described above (FIG. 2).

The flowmeter 24 detects the flow rate of water supply. The controller 9 reads a detection value of the flowmeter 24, and controls the flow rate of the pump 8.

As the humidifying material 1 of the humidifier according to Embodiment 10, a foam metal made of titanium with a porosity of 82% and a nominal hole diameter of 200 micrometers is used.

The other features of the configuration are similar to those in Embodiment 1 described above.

Next, an operation according to Embodiment 10 will be described.

Figure 18:
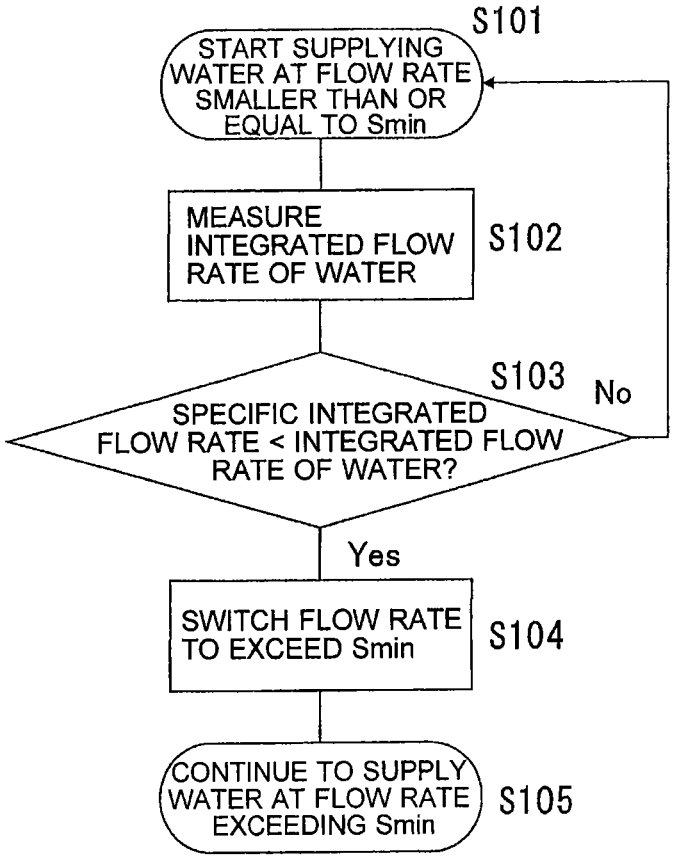
FIG. 18 is a flowchart illustrating a control operation of the humidifier according to Embodiment 10.

FIG. 18 is a flowchart illustrating a control operation of the humidifier according to Embodiment 10.

An example of the control operation of the controller 9 will be described with reference to FIG. 18.

The controller 9 starts supplying water to the humidifying material 1 by controlling the amount of water supplied by the water supply unit 3 to be smaller than or equal to a minimum value Smin (S101). For example, the amount of water supplied by the water supply unit 3 is controlled to the minimum value Smin.

The controller 9 obtains the integrated value (the integrated flow rate) of water supplied to the humidifying material 1, based on a detection value of the flowmeter 24 (S102). The controller 9 determines whether or not the integrated value (the integrated flow rate) of water supplied to the humidifying material 1 exceeds a preset amount (a specific integrated flow rate) (S103). Here, the preset amount is, for example, 300 L/m$^2$. Since the preset amount, which is to be compared with the integrated value of water supplied to the humidifying material 1, also depends on the specifications of the humidifying material 1 and the operation environment and conditions of the place where the humidifying material 1 is installed, the preset amount is not limited to this.

When the integrated value of water supplied to the humidifying material 1 does not exceed the preset amount (S103; No), the process returns to S101. Accordingly, when the integrated value of water supplied to the humidifying material 1 is smaller than or equal to the preset amount, the amount of water supplied by the water supply unit 3 is smaller than or equal to the minimum value Smin.

In contrast, when the integrated value of water supplied to the humidifying material 1 exceeds the preset amount (S103; Yes), the process proceeds to S104. The controller 9 switches the amount of water supplied by the water supply unit 3 to an amount of supply which exceeds the minimum value Smin (S104). After that, the controller 9 continues to supply water while maintaining the state in which the amount of water supplied by the water supply unit 3 exceeds the minimum value Smin (S105). For example, the controller 9 controls the amount of water supplied by the water supply unit 3 per preset time (for example, per unit time) to exceed the minimum value Smin so that the concentration ratio of water is 2 or below. The other features of the operation are similar to those in Embodiment 1.

The switching of the amount of water supply is not necessarily performed only when the preset amount has been reached. The switching of the amount of water supply may be performed during a period before the amount of humidification becomes smaller than or equal to the initial amount after increasing compared to the initial amount.

As described above, in Embodiment 10, when the amount of water supply is smaller than or equal to the preset integrated value of water, the amount of water supply is controlled to be smaller than or equal to the minimum value Smin, and therefore the humidifying performance can be enhanced by an improvement in a state of surface area caused by attachment of scales. Furthermore, when the amount of water supply exceeds the preset integrated value of water, the amount of water supply is controlled to exceed the minimum value Smin, and therefore a degradation of the humidifying performance can be suppressed by moderating concentration of a scale component on the humidifying material surface and suppressing attachment of scales. Accordingly, by switching the amount of water supply on the basis of the integrated value of supplied water, effects similar to those in Embodiment 1 can be achieved.

Embodiment 11

In Embodiment 11, an aspect in which the amount of water supply is switched based on a preset amount of attached scales, will be described.

FIG. 13 is a diagram illustrating a configuration of humidifiers according to Embodiments 1 and 11.

In FIG. 13, the humidifier according to Embodiment 11 includes a first electric conductivity meter 23*a*, a second electric conductivity meter 23*b*, and a flowmeter 24, in addition to the configuration according to Embodiment 1 described above (FIG. 2).

The first electric conductivity meter 23*a* detects the electric conductivity of water to be supplied to the humidifying material 1. The second electric conductivity meter 23*b* detects the electric conductivity of water drained through a drain pan 5.

The flowmeter 24 detects the flow rate of water supply. The controller 9 reads detection values of a first temperature and humidity sensor 10*a*, a second temperature and humidity sensor 10*b*, the first electric conductivity meter 23*a*, the second electric conductivity meter 23*b*, and the flowmeter 24, and controls the flow rate of the pump 8.

As the humidifying material 1 of the humidifier according to Embodiment 11, a foam metal made of titanium with a porosity of 82% and a nominal hole diameter of 200 micrometers is used.

The other features of the configuration are similar to those in Embodiment 1 described above.

Next, an operation according to Embodiment 11 will be described.

Figure 19:
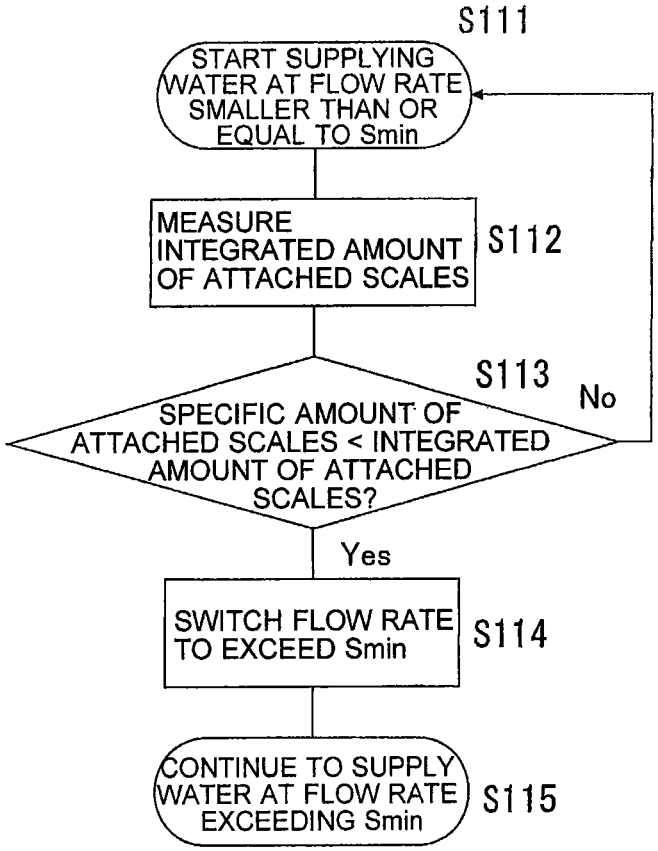
FIG. 19 is a flowchart illustrating a control operation of the humidifier according to Embodiment 11.

FIG. 19 is a flowchart illustrating a control operation of the humidifier according to Embodiment 11.

An example of the control operation of the controller 9 will be described with reference to FIG. 19.

The controller 9 starts supplying water to the humidifying material 1 by controlling the amount of water supplied by the water supply unit 3 to be smaller than or equal to a minimum value Smin (S111). For example, the amount of water supplied by the water supply unit 3 is controlled to the minimum value Smin.

The controller 9 obtains the integrated value of the amounts of attached scales (the integrated amount of attached scales), based on the amount of humidification calculated by the first temperature and humidity sensor 10*a* and the second temperature and humidity sensor 10*b*, the amount of water supplied to the humidifying material 1 calculated by the flowmeter 24, and a difference between the detection values of the first electric conductivity meter 23*a* and the second electric conductivity meter 23*b* (S112). The controller 9 determines whether or not the integrated value of the amounts of attached scales (the integrated amount of attached scales) exceeds a preset amount of attached scales (a specific amount of attached scales) (S113). Here, the preset amount of attached scales is, for example, 30 kg/m$^3$. Since the preset amount of attached scales also depends on the specifications of the humidifying material 1 and the operation environment and conditions of the place where the humidifying material 1 is installed, although the preset amount may be within a range from about 20 kg/m$^3$ to about 50 kg/m$^3$, it is not limited to this range.

When the integrated value of the amounts of attached scales does not exceed the preset amount of attached scales (S113; No), the process returns to S111. Accordingly, when the integrated value of the amounts of attached scales is smaller or equal to the preset amount of attached scales, the amount of water supplied by the water supply unit 3 is smaller than or equal to the minimum value Smin.

In contrast, when the integrated value of the amounts of attached scales exceeds the preset amount of attached scales (S113; Yes), the process proceeds to S114. The controller 9 switches the amount of water supplied by the water supply unit 3 to an amount of supply which exceeds the minimum value Smin (S114). After that, the controller 9 continues to supply water while maintaining the state in which the amount of water supplied by the water supply unit 3 exceeds the minimum value Smin (S115). For example, the controller 9 controls the amount of water supplied by the water supply unit 3 per preset time (for example, per unit time) to exceed the minimum value Smin so that the concentration ratio of water is 2 or below. The other features of the operation are similar to those in Embodiment 1.

The switching of the amount of water supply is not necessarily performed only when the integrated value of the amounts of attached scales has reached the preset amount of attached scales. The switching of the amount of water supply may be performed during a period before the amount of humidification becomes smaller than or equal to the initial amount after increasing compared to the initial amount.

As described above, in Embodiment 11, when the integrated value of the amounts of attached scales is smaller than or equal to the preset amount of attached scales, controlling to be smaller than or equal to the minimum value Smin is performed, and therefore the humidifying performance can be enhanced by an improvement in a state of surface area caused by attachment of scales. Furthermore, when the integrated value of the amounts of attached scales exceeds the preset amount of attached scales, the amount of water supply is controlled to exceed the minimum value Smin, and therefore a degradation of the humidifying performance can be suppressed by moderating concentration of a scale component on the humidifying material surface and suppressing attachment of scales. Accordingly, by switching the amount of water supply on the basis of the integrated value of the amounts of attached scales, effects similar to those in Embodiment 1 can also be achieved.

Embodiment 12

In Embodiment 12, an aspect in which the amount of water supply is switched based on a preset integrated value of the amounts of humidification, will be described.

As a humidifying material 1 of a humidifier according to Embodiment 12, a foam metal made of titanium with a porosity of 82% and a nominal hole diameter of 200 micrometers is used.

The other features of the configuration are similar to those in Embodiment 1 described above (FIG. 2).

Next, an operation according to Embodiment 12 will be described.

Figure 20:
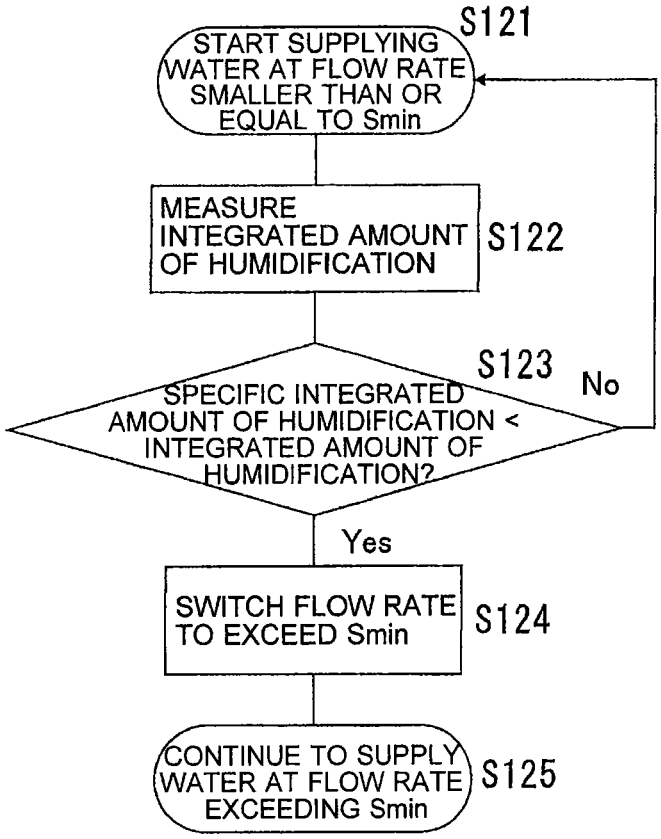
FIG. 20 is a flowchart illustrating a control operation of the humidifier according to Embodiment 12.

FIG. 20 is a flowchart illustrating a control operation of the humidifier according to Embodiment 12.

An example of the control operation of the controller 9 will be described with reference to FIG. 20.

The controller 9 starts supplying water to the humidifying material 1 by controlling the amount of water supplied by the water supply unit 3 to be smaller than or equal to a minimum value Smin (S121). For example, the amount of water supplied by the water supply unit 3 is controlled to the minimum value Smin.

The controller 9 obtains the integrated value of the amounts of humidification, based on the amount of humidification calculated by the first temperature and humidity sensor 10*a* and the second temperature and humidity sensor 10*b* (S122).

The controller 9 determines whether or not the integrated value of the amounts of humidification (the integrated amount of humidification) exceeds a preset amount (a specific integrated amount of humidification) (S123). Here, the preset amount is, for example, 290 L/m$^2$. Since the preset amount also depends on the specifications of the humidifying material 1 and the operation environment and conditions of the place where the humidifying material 1 is installed, the preset amount is not limited to this.

When the integrated value of the amounts of humidification does not exceed the preset amount (S123; No), the process returns to S121. Accordingly, when the integrated value of the amounts of humidification is smaller than or equal to the preset amount, the amount of water supplied by the water supply unit 3 is smaller than or equal to the minimum value Smin.

In contrast, when the integrated value of the amounts of humidification exceeds the preset amount (S123; Yes), the process proceeds to S124. The controller 9 switches the amount of water supplied by the water supply unit 3 to an amount of supply which exceeds the minimum value Smin (S124). After that, the controller 9 continues to supply water while maintaining the state in which the amount of water supplied by the water supply unit 3 exceeds the minimum value Smin (S125). For example, the controller 9 controls the amount of water supplied by the water supply unit 3 per preset time (for example, per unit time) to exceed the minimum value Smin so that the concentration ratio of water is 2 or below. The other features of the operation are similar to those in Embodiment 1.

The switching of the amount of water supply is not necessarily performed only when the integrated value of the amounts of humidification has reached the preset amount. The switching of the amount of water supply may be performed during a period before the amount of humidification becomes smaller than or equal to the initial amount after increasing compared to the initial amount.

As described above, in Embodiment 12, when the integrated value of the amounts of humidification is smaller than or equal to the preset amount, controlling to be smaller than or equal to the minimum value Smin is performed, and therefore the humidifying performance can be enhanced by an improvement in a state of surface area caused by attachment of scales. Furthermore, when the integrated value of the amounts of humidification exceeds the preset amount, the amount of water supply is controlled to exceed the minimum value Smin, and therefore a degradation of the humidifying performance can be suppressed by moderating concentration of a scale component on the humidifying material surface and suppressing attachment of scales. Accordingly, by switching the amount of water supply on the basis of the integrated value of the amounts of humidification, effects similar to those in Embodiment 1 can be achieved.

Embodiment 13

In Embodiment 13, an aspect in which the amount of water supply is switched based on a preset integrated value of the times of humidification, will be described.

As a humidifying material 1 of a humidifier according to Embodiment 13, a foam metal made of titanium with a porosity of 82% and a nominal hole diameter of 200 micrometers is used.

The other features of the configuration are similar to those in Embodiment 1 described above (FIG. 2).

Next, an operation according to Embodiment 13 will be described.

Figure 21:
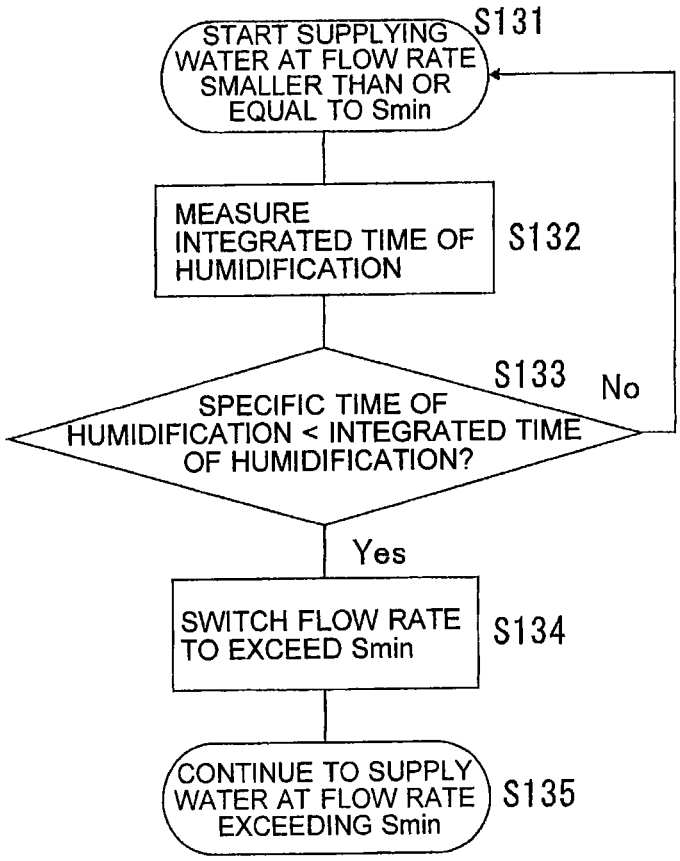
FIG. 21 is a flowchart illustrating a control operation of the humidifier according to Embodiment 13.

FIG. 21 is a flowchart illustrating a control operation of the humidifier according to Embodiment 13.

An example of the control operation of the controller 9 will be described with reference to FIG. 21.

The controller 9 starts supplying water to the humidifying material 1 by controlling the amount of water supplied by the water supply unit 3 to be smaller than or equal to a minimum value Smin (S131). For example, the amount of water supplied by the water supply unit 3 is controlled to the minimum value Smin.

The controller 9 obtains the integrated value of the times of humidification, based on the amount of humidification calculated by the first temperature and humidity sensor 10*a* and the second temperature and humidity sensor 10*b* (S132). Calculation of the integrated value of the times of humidification is not limited to this. The time elapsed since start of water supply from the water supply unit 3 to the humidifying material 1 may be defined as the integrated value of the times of humidification.

The controller 9 determines whether or not the integrated value of the times of humidification (the integrated time of humidification) exceeds a preset integrated time (a specific time of humidification) (S133). Here, the preset integrated time is, for example, 300 hours. Since the preset integrated time also depends on the specifications of the humidifying material 1 and the operation environment and conditions of the place where the humidifying material 1 is installed, the preset integrated time is not limited to this.

When the integrated time of the times of humidification does not exceed the preset integrated time (S133; No), the process returns to S131. Accordingly, when the integrated time of the times of humidification is shorter than or equal to the preset integrated time, the amount of water supplied by the water supply unit 3 is smaller than or equal to the minimum value Smin.

In contrast, when the integrated time of the times of humidification exceeds the preset integrated time (S133; Yes), the process proceeds to S134. The controller 9 switches the amount of water supplied by the water supply unit 3 to an amount of supply which exceeds the minimum value Smin (S134). After that, the controller 9 continues to supply water while maintaining the state in which the amount of water supplied by the water supply unit 3 exceeds the minimum value Smin (S135). For example, the controller 9 controls the amount of water supplied by the water supply unit 3 per preset time (for example, per unit time) to exceed the minimum value Smin so that the concentration ratio of water is 2 or below. The other features of the operation are similar to those in Embodiment 1.

The switching of the amount of water supply is not necessarily performed only when the preset integrated time has been reached. The switching of the amount of water supply may be performed during a period before the amount of humidification becomes smaller than or equal to the initial amount after increasing compared to the initial amount.

As described above, in Embodiment 13, when the integrated time of the times of humidification is shorter than or equal to the preset integrated time, controlling to be smaller than or equal to the minimum value Smin is performed, and therefore the humidifying performance can be enhanced by an improvement in a state of surface area caused by attachment of scales. Furthermore, when the integrated time of the times of humidification exceeds the preset integrated time, the amount of water supply is controlled to exceed the minimum value Smin, and therefore a degradation of the humidifying performance can be suppressed by moderating concentration of a scale component on the humidifying material surface and suppressing attachment of scales. Accordingly, by switching the amount of water supply on the basis of the integrated value of the times of humidification, effects similar to those in Embodiment 1 can be achieved.

REFERENCE SIGNS LIST

1: humidifying material, 2: fan, 3: water supply unit, 4: water feeding unit, 5: drain pan, 6: drain outlet, 7: humidifying performance control unit, 8: pump, 9: controller, 10*a*: first temperature and humidity sensor, 10*b*: second temperature and humidity sensor, 11: water tank, 12: diffuser tube, 13: ventilation pipe, 14: solenoid valve, 15: chemical liquid tank, 16: chemical liquid addition pump, 17: heater, 18: temperature sensor, 19: temperature adjusting device, 20: chemical agent filling cylinder, 21: void, 22: scale, 23*a*: first electric conductivity meter, 23*b*: second electric conductivity meter, 24: flowmeter, 25: air-blowing direction

The invention claimed is:

1. A humidifier comprising:

a humidifying material that evaporates water which is impregnated therein to humidify air;

a water supply unit that supplies water to the humidifying material;

a fan that blows air toward the humidifying material; and a controller that controls an amount of water supplied by the water supply unit, wherein the controller comprises:

means for causing the water supply unit to supply water to the humidifying material at a flow rate smaller than a minimum value of the amount of water providing the humidifying material with a maximum amount of humidification, and means for subsequently causing the water supply unit to supply water to the humidifying material at a flow rate equal to or exceeding the minimum value.

2. The humidifier of claim 1, wherein the controller obtains an amount of humidification, which is an amount of water evaporated by the humidifying material per preset time, causes the water supply unit to supply water to the humidifying material at a flow rate smaller than a minimum value of the amount of water providing the humidifying material with a maximum amount of humidification so long as the obtained amount of humidification obtained at a present time is increases over a previous time, and subsequently causes the water supply unit to supply water to the humidifying material at a flow rate equal to or exceeding the minimum value beginning when the obtained amount of humidification ceases to increase over the previous time.

3. The humidifier of claim 2, further comprising:

a water tank that stores the water to be supplied to the humidifying material;

a diffuser tube that is arranged inside the water tank and that supplies air to the water in the water tank; and an opening/closing valve that switches between supply and non-supply of air from the diffuser tube, wherein the controller:

controls the opening/closing valve to enter an opened state in the case where the amount of humidification obtained at the present time is increased compared to the amount of humidification obtained at the previous time, and controls the opening/closing valve to enter a closed state in the case where the amount of humidification obtained at the present time is decreased compared to the amount of humidification obtained at the previous time or in the case where the amount of humidification obtained at the present time is equal to the amount of humidification obtained at the previous time.

4. The humidifier of claim 2, further comprising:

a chemical liquid addition unit that supplies an ionic additive to the water to be supplied to the humidifying material, wherein the controller causes the chemical liquid addition unit to supply the ionic additive to the water in the case where the amount of humidification obtained at the present time is increased compared to the amount of humidification obtained at the previous time, and causes the chemical liquid addition unit to stop supplying the ionic additive in the case where the amount of humidification obtained at the present time is decreased compared to the amount of humidification obtained at the previous time or in the case where the amount of humidification obtained at the present time is equal to the amount of humidification obtained at the previous time.

5. The humidifier of claim 2, further comprising:

a heating unit that heats the water to be supplied to the humidifying material, wherein the controller operates the heating unit to heat the water in the case where the amount of humidification obtained at the present time is increased compared to the amount of humidification obtained at the previous time, and stops the operation of the heating unit in the case where the amount of humidification obtained at the present time is decreased compared to the amount of humidification obtained at the previous time or in the case where the amount of humidification obtained at the present time is equal to the amount of humidification obtained at the previous time.

6. The humidifier of claim 2, further comprising:

a chemical agent filling unit that supplies at least one of chemical agents from among calcium carbonate, calcium hydrogencarbonate, and silica gel to the water to be supplied to the humidifying material, wherein the controller causes the chemical agent filing unit to supply the chemical agent to the water in the case where the amount of humidification obtained at the present time is increased compared to the amount of humidification obtained at the previous time, and causes the chemical agent filling unit to stop supplying the chemical agent in the case where the amount of humidification obtained at the present time is decreased compared to the amount of humidification obtained at the previous time or in the case where the amount of humidification obtained at the present time is equal to the amount of humidification obtained at the previous time.

7. The humidifier of claim 2, wherein the controller subsequently causes the water supply unit to supply water to the humidifying material at a flow rate equal to or exceeding the minimum value beginning when an integrated value of the amounts of humidification exceeds a preset integrated value.

8. The humidifier of claim 2, further comprising a first temperature and humidity sensor that detects a temperature and a humidity of the air before passing through a surface of the humidifying material, and a second temperature and humidity sensor that detects a temperature and a humidity of the air after passing through the surface of the humidifying material, wherein the controller obtains the amount of humidification based on detection values of the first temperature and humidity sensor and the second temperature and humidity sensor.

9. The humidifier of claim 1, wherein the controller subsequently causes the water supply unit to supply water to the humidifying material at a flow rate equal to or exceeding the minimum value beginning when an integrated value of water supplied from the water supply unit to the humidifying material exceeds a preset amount.

10. The humidifier of claim 1, wherein the controller subsequently causes the water supply unit to supply water to the humidifying material at a flow rate equal to or exceeding the minimum value beginning when an amount of attached scales accumulated on the humidifying material exceeds a preset amount of attached scales.

11. The humidifier of claim 1, wherein the controller subsequently causes the water supply unit to supply water to the humidifying material at a flow rate equal to or exceeding the minimum value beginning when an integrated time of times of humidification exceeds a preset integrated time.

* * * * *